US007784529B2

(12) United States Patent
Higashiyama

(10) Patent No.: US 7,784,529 B2
(45) Date of Patent: Aug. 31, 2010

(54) HEAT EXCHANGER

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 732 days.

(21) Appl. No.: 11/720,372

(22) PCT Filed: Nov. 30, 2005

(86) PCT No.: PCT/JP2005/022416

§ 371 (c)(1),
(2), (4) Date: May 29, 2007

(87) PCT Pub. No.: WO2006/059783

PCT Pub. Date: Jun. 8, 2006

(65) Prior Publication Data

US 2008/0041095 A1 Feb. 21, 2008

Related U.S. Application Data

(60) Provisional application No. 60/632,985, filed on Dec. 6, 2004.

(30) Foreign Application Priority Data

Nov. 30, 2004 (JP) ..... 2004-345588

(51) Int. Cl.
*F28F 9/02* (2006.01)
*F28D 1/02* (2006.01)

(52) U.S. Cl. ..... 165/174; 165/153

(58) Field of Classification Search ..... 165/173, 165/174, 176, 178, 153, 103; 62/525, 526; 138/38, 39

See application file for complete search history.

(56) References Cited

U.S. PATENT DOCUMENTS 2,488,623 A * 11/1949 Goeltz ..... 138/38
3,191,672 A * 6/1965 Logan ..... 165/119
5,415,223 A * 5/1995 Reavis et al. ..... 165/96

(Continued)

FOREIGN PATENT DOCUMENTS

JP 11 201685 7/1999

(Continued)

OTHER PUBLICATIONS

U.S. Appl. No. 11/571,831, filed Jan. 9, 2007, Higashiyama.

*Primary Examiner*—Tho v Duong
(74) *Attorney, Agent, or Firm*—Oblon, Spivak, McClelland, Maier & Neustadt, L.L.P.

(57) ABSTRACT

An evaporator includes a refrigerant inlet header section having a refrigerant inlet at a first end portion thereof and plural heat exchange tubes disposed at predetermined intervals in the longitudinal direction of the refrigerant inlet header section and connected at respective first end portions thereof to the refrigerant inlet header section. A flow-dividing control wall divides the refrigerant inlet header section interior into an upper space, into which a refrigerant flows through the refrigerant inlet, and a lower space, with which the heat exchange tubes communicate. A communication hole in the flow-dividing control wall at an end portion opposite the first end portion establishes communication between the spaces therethrough. A flow-division-adjusting hole communicating with the lower space formed at the first end portion of the refrigerant inlet header section allows the refrigerant to flow into the lower space therethrough without passing through the upper space.

17 Claims, 12 Drawing Sheets

U.S. PATENT DOCUMENTS

| | | | | |
|---|---|---|---|---|
| 5,934,367 | A * | 8/1999 | Shimmura et al. | 165/174 |
| 6,082,448 | A * | 7/2000 | Haussmann | 165/174 |
| 6,199,401 | B1 * | 3/2001 | Haussmann | 62/525 |
| 2004/0159121 | A1 * | 8/2004 | Horiuchi et al. | 62/526 |

FOREIGN PATENT DOCUMENTS

| | | |
|---|---|---|
| JP | 2001 255095 | 9/2001 |
| JP | 2003 75024 | 3/2003 |
| JP | 2004 239592 | 8/2004 |

* cited by examiner

HEAT EXCHANGER

CROSS REFERENCE TO RELATED APPLICATIONS

This application is an application filed under 35 U.S.C. §111(a) claiming the benefit pursuant to 35 U.S.C. §119(e)(1) of the filing date of Provisional Application No. 60/632,985 filed Dec. 6, 2004 pursuant to 35 U.S.C. §111(b).

TECHNICAL FIELD

The present invention relates to a heat exchanger, and more particularly to a heat exchanger preferably used as an evaporator of a car air conditioner, which is a refrigeration cycle to be mounted on, for example, an automobile.

Herein and in the appended claims, the term "aluminum" includes aluminum alloys in addition to pure aluminum. Also, herein and in the appended claims, the downstream side (a direction represented by arrow X in FIG. 1) of an air flow through air-passing clearances between adjacent heat exchange tubes will be referred to as the "front," and the opposite side as the "rear."

BACKGROUND ART

Conventionally, a so-called laminated evaporator has been widely used as an evaporator for use in a car air conditioner. In the laminated evaporator, a plurality of flat, hollow members, each of which includes a pair of depressed plates facing each other and brazed to each other at their peripheral edge portions, are arranged in parallel, and louvered corrugate fins are each disposed between and brazed to the adjacent flat, hollow members. In recent years, evaporators have been required to be reduced further in size and weight and to exhibit higher performance.

The inventors of the present invention have proposed an evaporator which fulfills the above requirements (refer to Patent Document 1). The evaporator includes a heat exchange core section configured such that heat exchange tube groups are arranged in two rows in a front-rear direction, each heat exchange tube group consisting of a plurality of heat exchange tubes arranged at predetermined intervals; a refrigerant inlet/outlet header tank disposed on an upper-end side of the heat exchange core section; and a refrigerant turn header tank disposed on a lower-end side of the heat exchange core section. A partition wall divides the interior of the refrigerant inlet/outlet header tank into a refrigerant inlet header section located frontward of the partition wall, and a refrigerant outlet header section located rearward of the partition wall. A refrigerant inlet is formed at a first end portion of the refrigerant header section, and a refrigerant outlet is formed at an end portion, corresponding to the first end portion of the refrigerant header section, of the refrigerant outlet header section. A partition wall divides the interior of the refrigerant turn header tank into a refrigerant inflow header section located frontward of the partition wall, and a refrigerant outflow header section located rearward of the partition wall. A plurality of refrigerant passage holes are formed in the partition wall of the refrigerant turn header tank at predetermined intervals in a longitudinal direction. Upper end portions of the heat exchange tubes of the front heat exchange tube group are connected to the refrigerant inlet header section, whereas upper end portions of the heat exchange tubes of the rear heat exchange tube group are connected to the refrigerant outlet header section. Lower end portions of the heat exchange tubes of the front heat exchange tube group are connected to the refrigerant inflow header section, whereas lower end portions of the heat exchange tubes of the rear heat exchange tube group are connected to the refrigerant outflow header section. A refrigerant which flows into the refrigerant inlet header section of the refrigerant inlet/outlet header tank passes through the heat exchange tubes of the front heat exchange tube group to thereby flow into the refrigerant inflow header section of the refrigerant turn header tank; passes through the refrigerant passage holes of the partition wall to thereby flow into the refrigerant outflow header section; and passes through the heat exchange tubes of the rear heat exchange tube group to thereby flow into the refrigerant outlet header section of the refrigerant inlet/outlet header tank (see Japanese Patent Application Laid-Open (kokai) No. 2003-75024).

However, various studies conducted by the present inventors have revealed that enhancing heat exchange performance to a higher level is difficult for the evaporator described in the above-mentioned publication, for the reason described below.

As compared with the laminated evaporator, the evaporator described in the above-mentioned publication is likely to be greater in cross-sectional area of a channel within the refrigerant inlet header, so that channel resistance is likely to become lower. However, since the overall internal volume of the refrigerant inlet header section with which the heat exchange tubes communicate becomes large, response tends to become slow, particularly, at the time of on-off control of a compressor. Specifically, even when the compressor is turned on, much time may be consumed before the evaporator begins to be cooled, for the following reasons: since the overall internal volume of the refrigerant inlet header section is large, the flow velocity of refrigerant becomes low; and since the overall internal volume of the refrigerant inlet header section with which the heat exchange tubes communicate is large, the refrigerant does not begin to flow into the heat exchange tubes until the quantity of refrigerant within the refrigerant inlet header section builds up to a certain level. On the contrary, even when the compressor is turned off, distribution of temperature rises in the evaporator may become nonuniform with a resultant nonuniform temperature distribution of discharged air; i.e., a nonuniform temperature distribution of air that has passed through the heat exchange core section, for the following reason: since the overall internal volume of the refrigerant inlet header section is large, distribution of the quantity of refrigerant remaining within the refrigerant inlet header becomes nonuniform with respect to the direction in which the heat exchange tubes are arranged. Further, since the internal volume of the refrigerant inlet header section becomes large, at low refrigerant flow rate, the refrigerant which has flowed into the refrigerant inlet header section becomes unlikely to flow up to a distant location from the refrigerant inlet. In the front heat exchange tube group, a large amount of refrigerant flows into the heat exchange tubes located near the refrigerant inlet, so that the refrigerant flow rate in the heat exchange tubes becomes high; and a small amount of refrigerant flows into the heat exchange tubes located away from the refrigerant inlet, so that the refrigerant flow rate in the heat exchange tubes becomes low. Also, in the rear heat exchange tube group, the refrigerant flow rate in the heat exchange tubes located near the refrigerant inlet becomes high, and the refrigerant flow rate in the heat exchange tubes located away from the refrigerant inlet becomes low. As a result, distribution of the quantity of refrigerant contributing to heat exchange becomes nonuniform in the heat exchange core section with respect to the longitudinal direction of the refrigerant inlet/outlet tank, and the temperature distribution of discharged air becomes locally nonuniform, potentially resulting in a failure to sufficiently yield the effect of enhancing the heat exchange performance of the evaporator.

An object of the present invention is to solve the above problem and to provide a heat exchanger which exhibits excellent heat exchange performance, particularly when used as an evaporator.

DISCLOSURE OF THE INVENTION

To achieve the above object, the present invention comprises the following modes.

1) A heat exchanger comprising a refrigerant inlet header section having a refrigerant inlet at a first end portion thereof and a plurality of heat exchange tubes disposed at predetermined intervals in the longitudinal direction of the refrigerant inlet header section and connected at respective first end portions thereof to the refrigerant inlet header section, wherein the interior of the refrigerant inlet header section is divided into a first space into which a refrigerant flows through the refrigerant inlet, and a second space which communicates with the heat exchange tubes; the first and second spaces communicate with each other via a communication portion so as to generate, in the second space, a flow of the refrigerant in a direction counter to a refrigerant flow direction in the first space; and a flow-division-adjusting refrigerant inflow port communicating with the second space is formed at the first end portion of the refrigerant inlet header section such that the refrigerant flows into the second space through the flow-division-adjusting refrigerant inflow port without passing through the first space.

2) A heat exchanger according to par. 1), wherein the refrigerant flows into the second space from the first space while changing its course in a U-turn manner during passage through the communication portion.

3) A heat exchanger according to par. 1), wherein the first and second spaces of the refrigerant inlet header section communicate with each other via the communication portion at an end portion opposite the first end portion of the refrigerant inlet header section.

4) A heat exchanger according to par. 1), wherein the interior of the refrigerant inlet header section is divided into the first space and the second space by flow-dividing control means, and the communication portion comprises a communication hole formed in the flow-dividing control means.

5) A heat exchanger according to par. 4), wherein one end of the refrigerant inlet header section is closed to form a closed portion, and the refrigerant inlet communicating with the first space, and the flow-division-adjusting refrigerant inflow port assuming the form of a hole and communicating with the second space are formed at the closed portion.

6) A heat exchanger according to par. 5), wherein the opening area of the communication hole is greater than the opening area of the flow-division-adjusting refrigerant inflow port.

7) A heat exchanger according to par. 6), wherein the relation $0.05 \leqq A2/A1 \leqq 0.48$ is satisfied, where A1 is the opening area in $mm^2$ of the communication hole, and A2 is the opening area in $mm^2$ of the flow-division-adjusting refrigerant inflow port.

8) A heat exchanger according to par. 1), comprising a refrigerant inlet header section having a refrigerant inlet, a refrigerant outlet header section located rearward of the refrigerant inlet header section and having a refrigerant outlet, and a refrigerant circulation path establishing communication between the refrigerant inlet header section and the refrigerant outlet header section, wherein the refrigerant circulation path comprises at least two intermediate header sections, and a plurality of heat exchange tubes establishing communication among the refrigerant inlet header section, the refrigerant outlet header section, and all the intermediate header sections.

9) A heat exchanger according to par. 1), comprising a heat exchange core section configured such that heat exchange tube groups are arranged in a plurality of rows in a front-rear direction, each heat exchange tube group consisting of a plurality of heat exchange tubes arranged at predetermined intervals and such that fins are respectively disposed between the adjacent heat exchange tubes; a refrigerant inlet header section which is disposed on a first-end side of the heat exchange tubes and to which the heat exchange tubes of at least a single heat exchange tube group are connected; a refrigerant outlet header section which is disposed on the first-end side of the heat exchange tubes and rearward of the refrigerant inlet header section and to which the heat exchange tubes of the remaining exchange tube group(s) are connected; a refrigerant-inflow-side intermediate header section which is disposed on a second-end side of the heat exchange tubes and to which the heat exchange tubes connected to the refrigerant inlet header section are connected; and a refrigerant-outflow-side intermediate header section which is disposed on the second-end side of the heat exchange tubes and rearward of the refrigerant-inflow-side intermediate header section and to which the heat exchange tubes of the heat exchange tube group connected to the refrigerant outlet header section are connected.

10) A heat exchanger according to par. 9), wherein the heat exchange tubes are each in a flat form and are arranged such that their widths extend in the front-rear direction, and the individual heat exchange tubes have a tube height of 0.75 mm to 1.5 mm.

11) A heat exchanger according to par. 9), wherein each of the fins is in a corrugate form and comprises wave crest portions, wave trough portions, and flat connection portions connecting together the wave crest portions and the wave trough portions; and each of the fins has a fin height of 7.0 mm to 10.0 mm and a fin pitch of 1.3 mm to 1.7 mm.

12) A heat exchanger according to par. 9), wherein each of the wave crest portions and the wave trough portions of the corrugate fin comprises a flat portion, and round portions located at corresponding opposite ends of the flat portion and connected to the corresponding connection portions; and the round portions have a radius of curvature of 0.7 mm or less.

13) A heat exchanger according to par. 9), wherein the refrigerant inlet header section and the refrigerant outlet header section are provided in a single header tank.

14) A heat exchanger according to par. 13), wherein the header tank comprises a first member to which the heat exchange tubes are connected, a second member which is brazed to the first member on a side opposite the heat exchange tubes, and two closing members brazed to corresponding opposite ends of the first and second members.

15) A heat exchanger according to par. 14), wherein the refrigerant inlet communicating with the first space of the refrigerant inlet header section, the flow-division-adjusting refrigerant inflow port communicating with the second space of the refrigerant inlet header section, and the refrigerant outlet communicating with the refrigerant outlet header section are formed in one of the two closing members.

16) A refrigeration cycle comprising a compressor, a condenser, and an evaporator, the evaporator being a heat exchanger according to any one of pars. 1) to 15).

17) A vehicle having installed therein a refrigeration cycle according to par. 16) as a car air conditioner.

In the heat exchanger according to any one of pars. 1) to 3), the interior of the refrigerant inlet header section is divided into the first space into which a refrigerant flows through the refrigerant inlet, and the second space which communicates with the heat exchange tubes; the first and second spaces communicate with each other via the communication portion so as to generate, in the second space, a flow of the refrigerant in a direction counter to a refrigerant flow direction in the first space; and the flow-division-adjusting refrigerant inflow port communicating with the second space is formed at the first end portion, where the refrigerant inlet is formed, of the refrigerant inlet header section such that the refrigerant flows into the second space therethrough without passing through the first space. Thus, as compared with the evaporator described in Patent Document 1, the flow velocity of the refrigerant within the first and second spaces of the refrigerant inlet header section becomes higher, and the internal volume of the space with which the heat exchange tubes communicate becomes smaller. By virtue of these features combined with the structural feature that the refrigerant flows into the second space through the flow-division-adjusting refrigerant inflow port without passing through the first space, when the heat exchanger is used as an evaporator, upon a compressor being turned on, the quantity of refrigerant flowing into the second space promptly builds up to a predetermined level, and the refrigerant flows into the heat exchange tubes. Thus, time that elapses before the evaporator begins to be cooled is shortened. On the contrary, upon the compressor being turned off, the variation, in the direction in which the heat exchange tubes are arranged, of the quantity of the refrigerant remaining in the second space is suppressed, so that distribution of temperature rises in the evaporator becomes uniform, with a resultant uniform temperature distribution of discharged air. Accordingly, at the time of on-off control of the compressor, the evaporator exhibits quick response. Further, since the flow velocity of the refrigerant within the first and second spaces becomes high, even at low refrigerant flow rate, the refrigerant that has flowed into the refrigerant inlet header section readily flows throughout the second space, so that the refrigerant flow rate becomes uniform among the heat exchange tubes connected to the refrigerant inlet header section. As a result, distribution of the quantity of refrigerant contributing to heat exchange becomes uniform in the heat exchange core section with respect to the longitudinal direction of the refrigerant inlet header section, and the temperature distribution of air that has passed through the heat exchange core section becomes uniform throughout. Therefore, the heat exchange performance of the heat exchanger is greatly enhanced. Particularly, even at low refrigerant flow rate, an impairment in heat exchange performance is prevented. Further, even when the refrigerant flow rate varies or even when air velocity varies along the longitudinal direction of the refrigerant inlet header section, the division of refrigerant flow among the heat exchange tubes connected to the refrigerant inlet header section can be optimized. Also, at low refrigerant flow rate, a large quantity of refrigerant can be caused to flow to the most distant region from the refrigerant inlet in the second space, thereby enhancing heat exchange performance.

With the heat exchanger of par. 4), in a relatively simple manner, the interior of the refrigerant inlet header can be divided into the two spaces, and the communication portion can be formed.

With the heat exchanger of par. 5), the flow-division-adjusting refrigerant inflow port allows the refrigerant to flow into the second space without passing through the first space, by means of a relatively simple configuration.

With the heat exchanger of par. 6), the quantity of the refrigerant flowing into the second space from the first space through the communication hole and the quantity of the refrigerant flowing into the second space through the flow-division-adjusting refrigerant inflow port can be rendered favorable. With the heat exchanger of par. 7), the quantities can be optimized.

With the heat exchanger of par. 10), while an increase in air flow resistance is suppressed, heat exchange performance is improved, thereby establishing good balance therebetween.

With the heat exchanger of par. 11), while an increase in air flow resistance is suppressed, heat exchange performance is improved, thereby establishing good balance therebetween.

With the heat exchanger of par. 13) or 14), the number of components can be reduced.

With the heat exchanger of par. 15), the refrigerant inlet, the flow-division-adjusting refrigerant inflow port, and the refrigerant outlet can be formed in a relatively simple configuration.

BEST MODE FOR CARRYING OUT THE INVENTION

An embodiment of the present invention will next be described in detail with reference to the drawings. The embodiment is of a heat exchanger according to the present invention that is applied to an evaporator of a car air conditioner using a chlorofluorocarbon-based refrigerant.

In the following description, the upper, lower, left-hand, and right-hand sides of FIGS. 1 and 2 will be referred to as "upper," "lower," "left," and "right," respectively.

Figure 1:
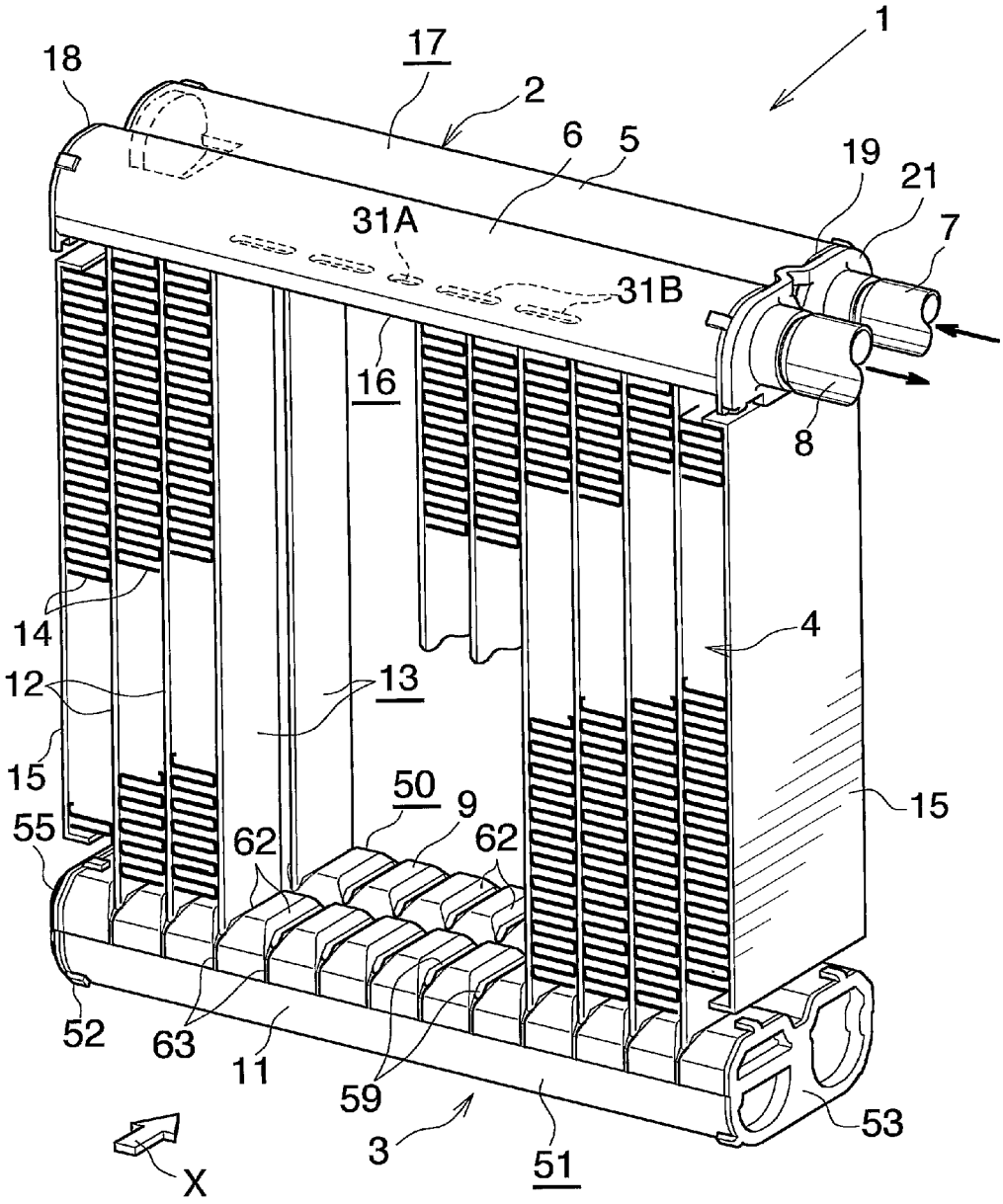
FIG. 1 is a partially cut-away perspective view showing the overall configuration of an evaporator to which a heat exchanger according to the present invention is applied.
Figure 2:
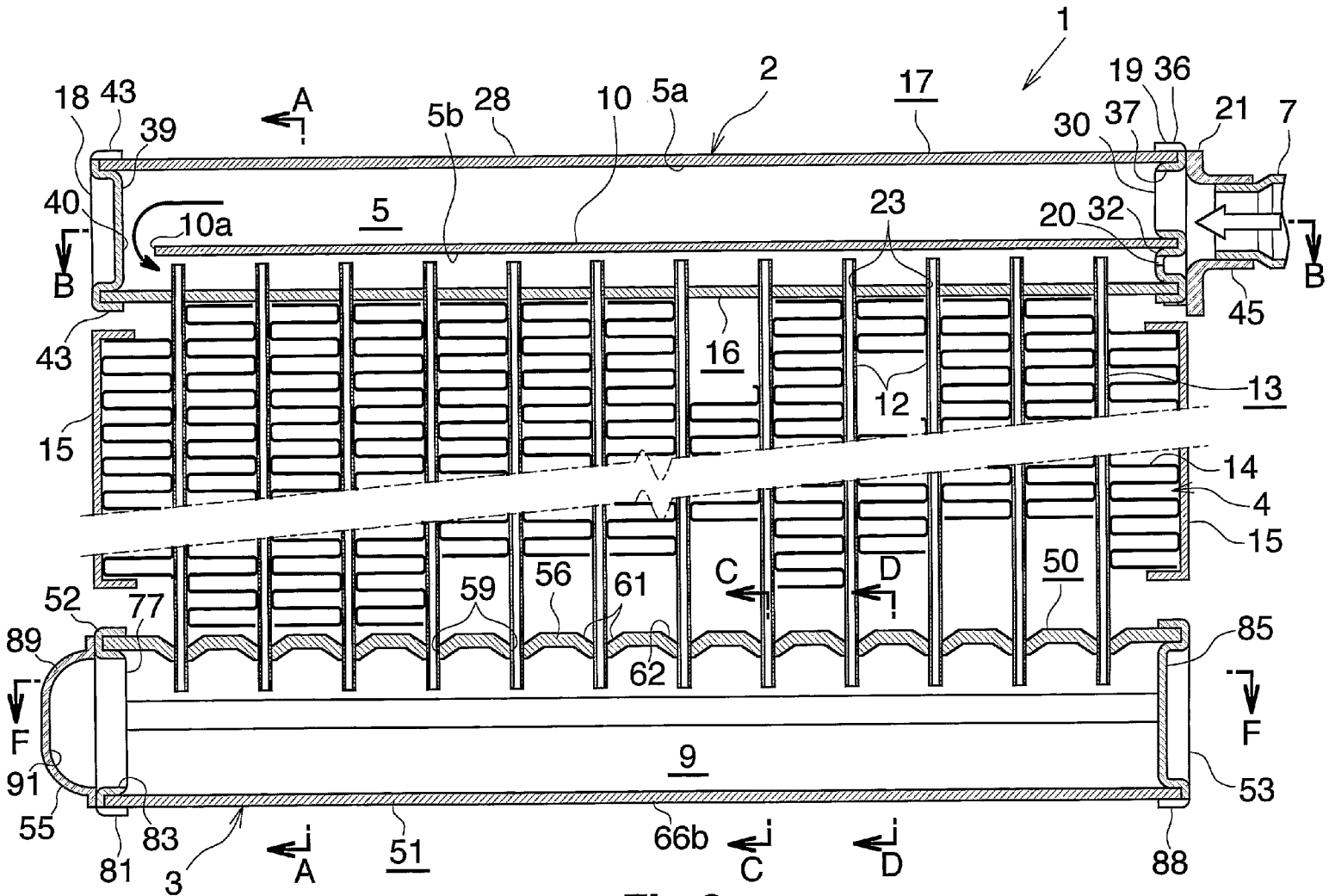
FIG. 2 is a fragmentary view in vertical section showing the heat exchanger as it is seen from the rear, with its intermediate portion omitted.
Figure 3:
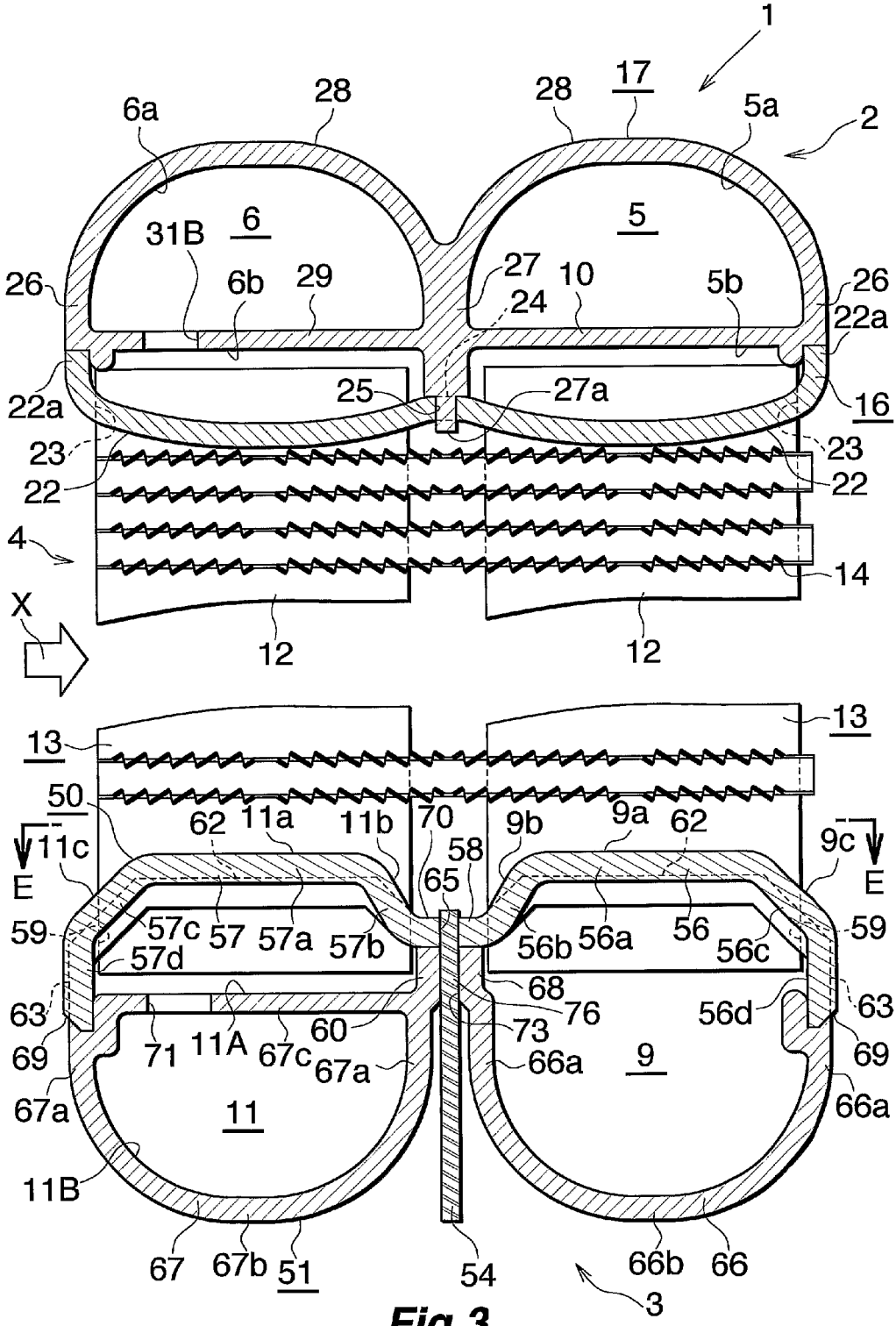
FIG. 3 is an enlarged fragmentary view in section taken along line A-A of FIG. 2.
Figure 4:
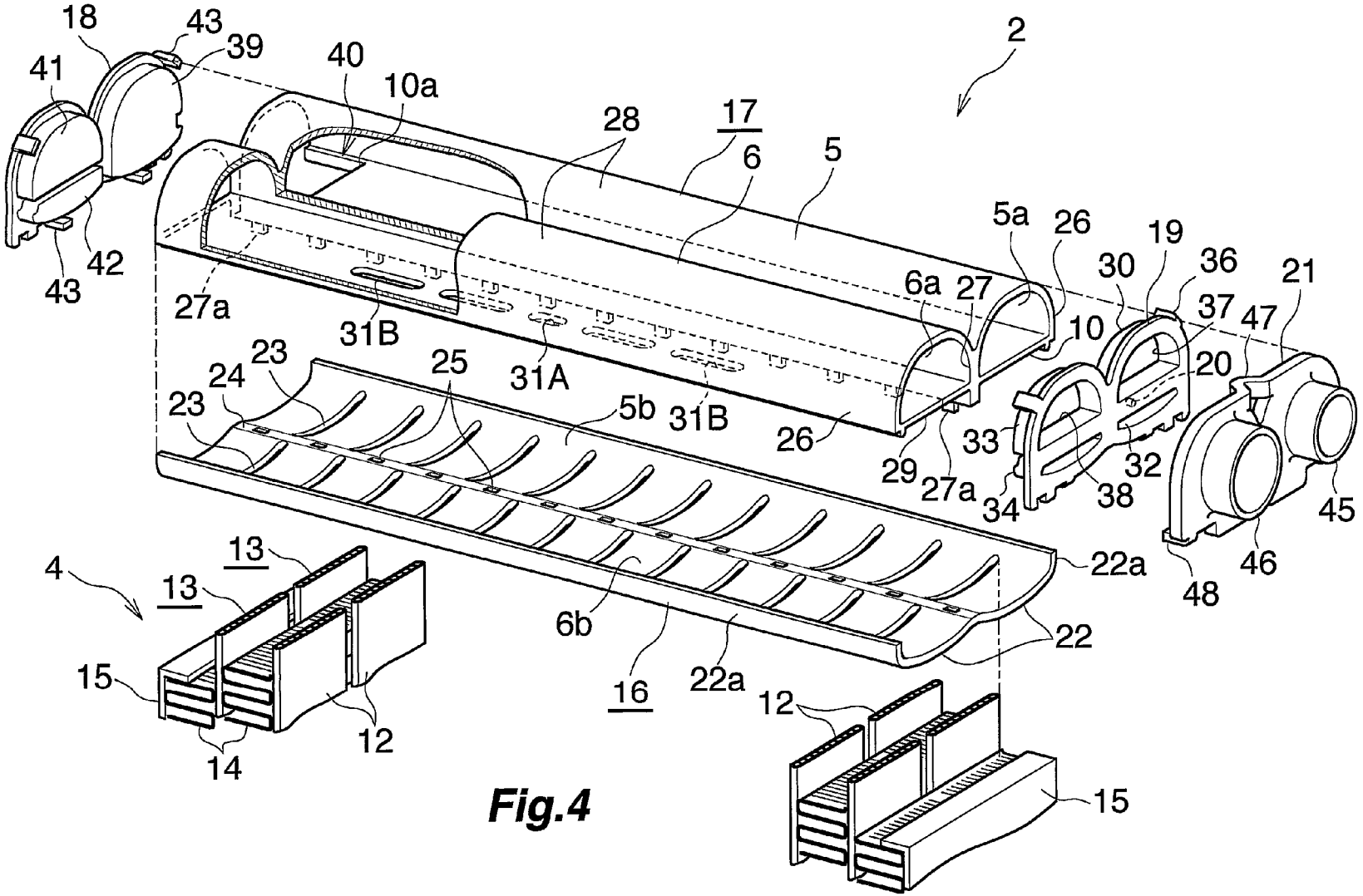
FIG. 4 is an exploded perspective view of a refrigerant inlet/outlet header tank of the evaporator shown in FIG. 1.
Figure 5:
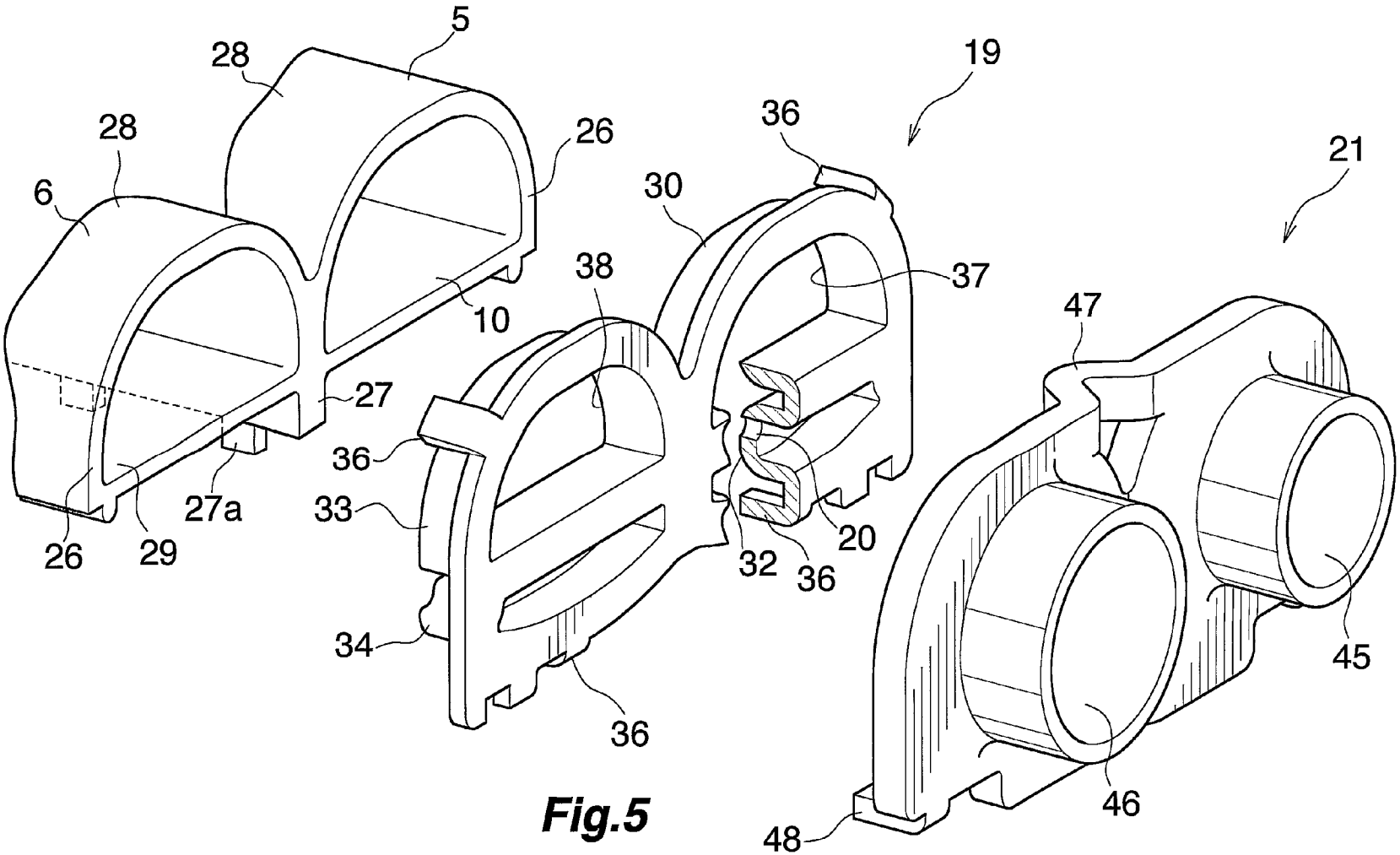
FIG. 5 is a partially enlarged view of FIG. 4.
Figure 6:
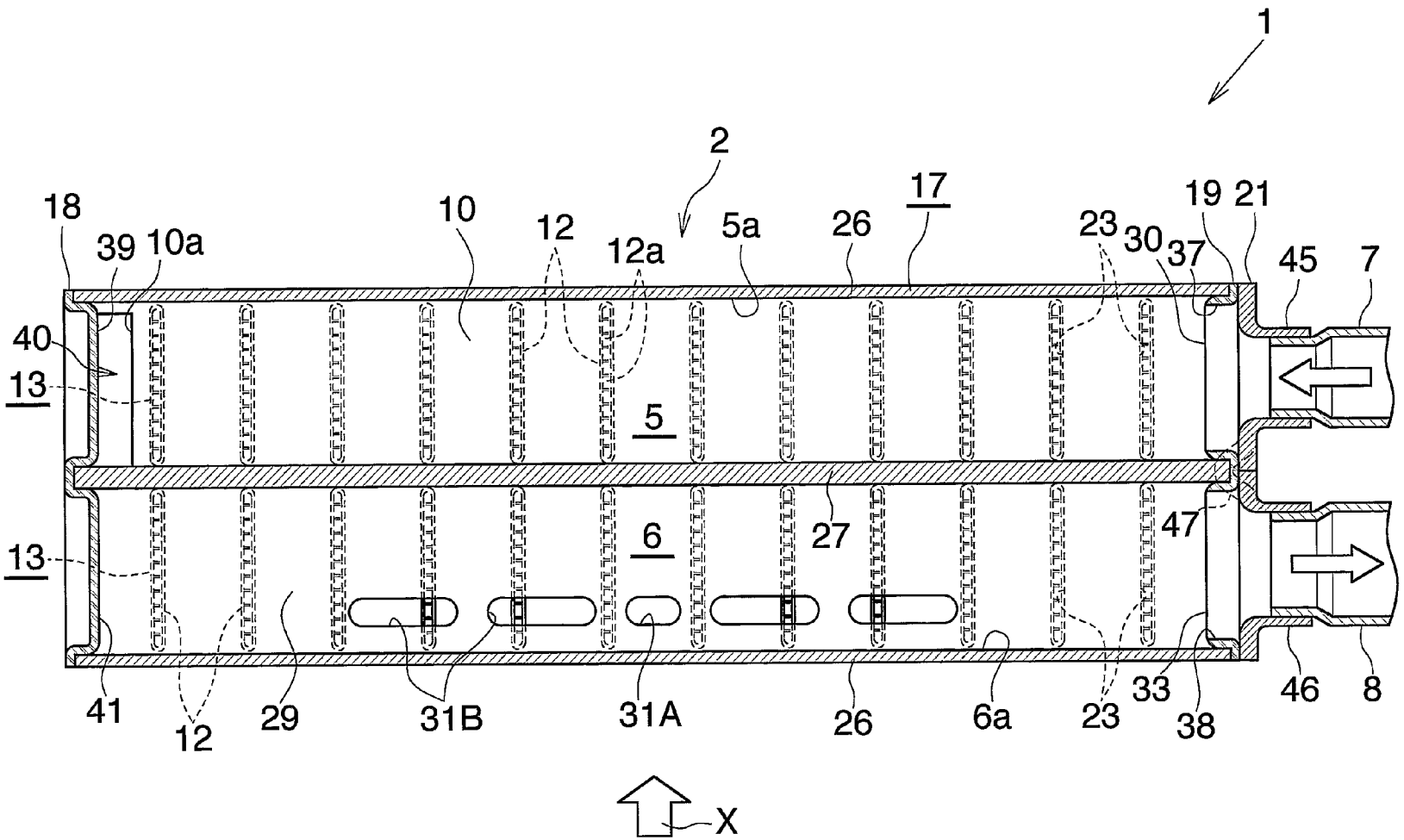
FIG. 6 is an enlarged view in section taken along line B-B of FIG. 2.
Figure 7:
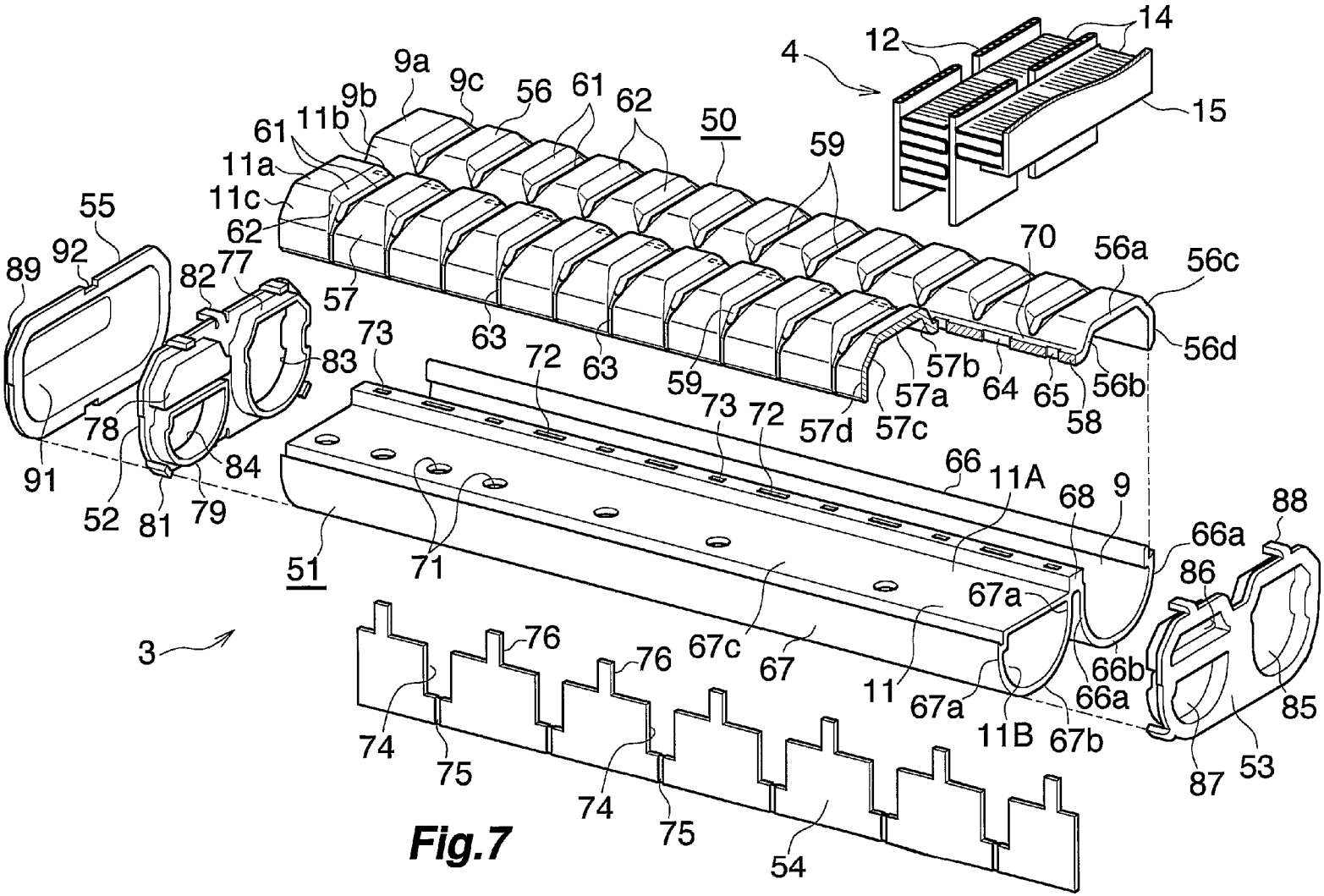
FIG. 7 is an exploded perspective view of a refrigerant turn tank of the evaporator shown in FIG. 1.
Figure 8:
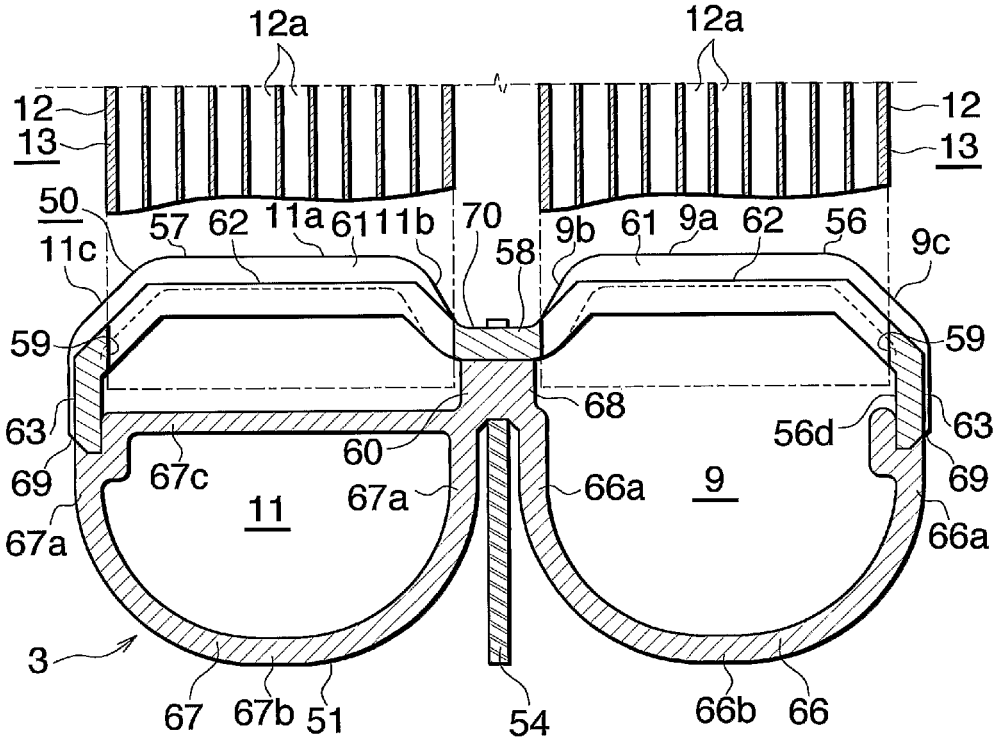
FIG. 8 is an enlarged sectional view taken along line C-C of FIG. 2.
Figure 9:
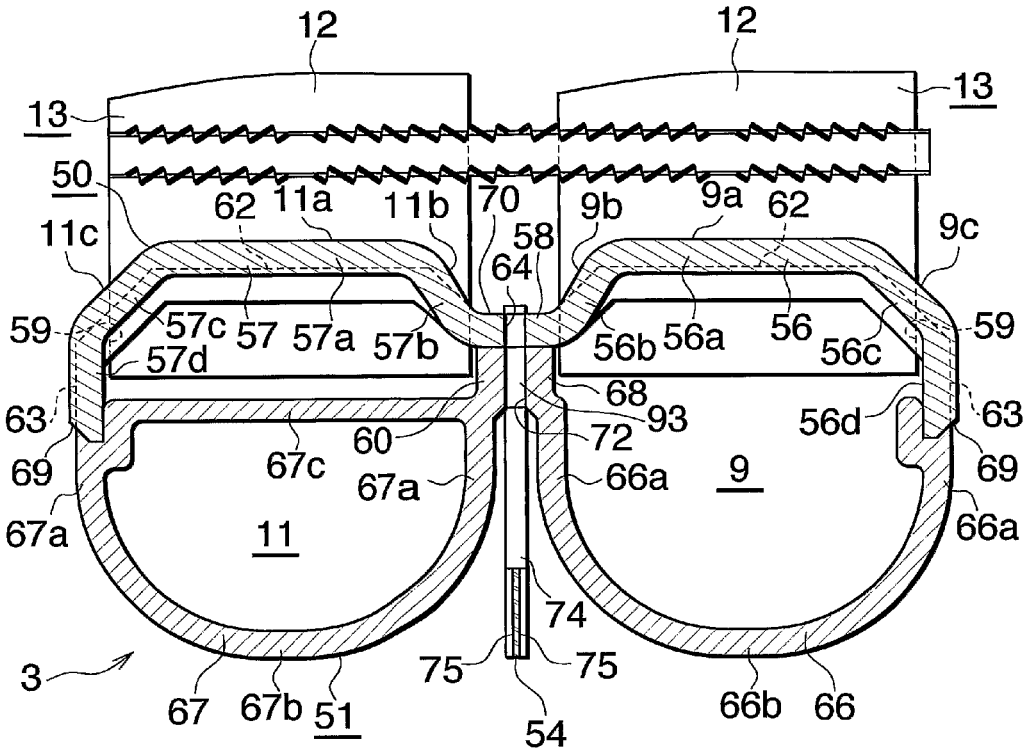
FIG. 9 is an enlarged sectional view taken along line D-D of FIG. 2.
Figure 10:
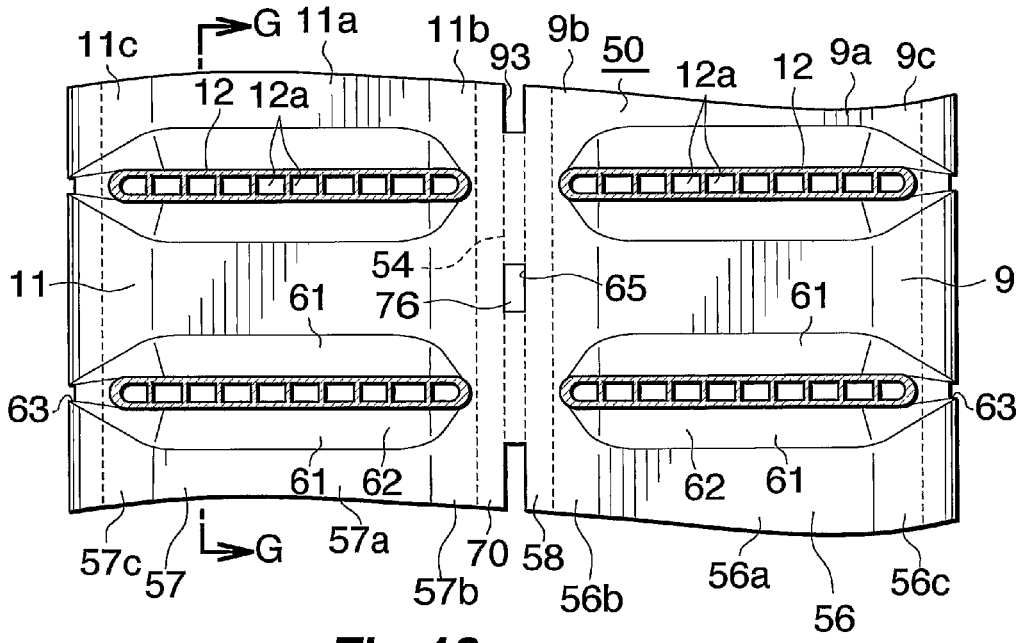
FIG. 10 is a sectional view taken along line E-E of FIG. 3.
Figure 11:
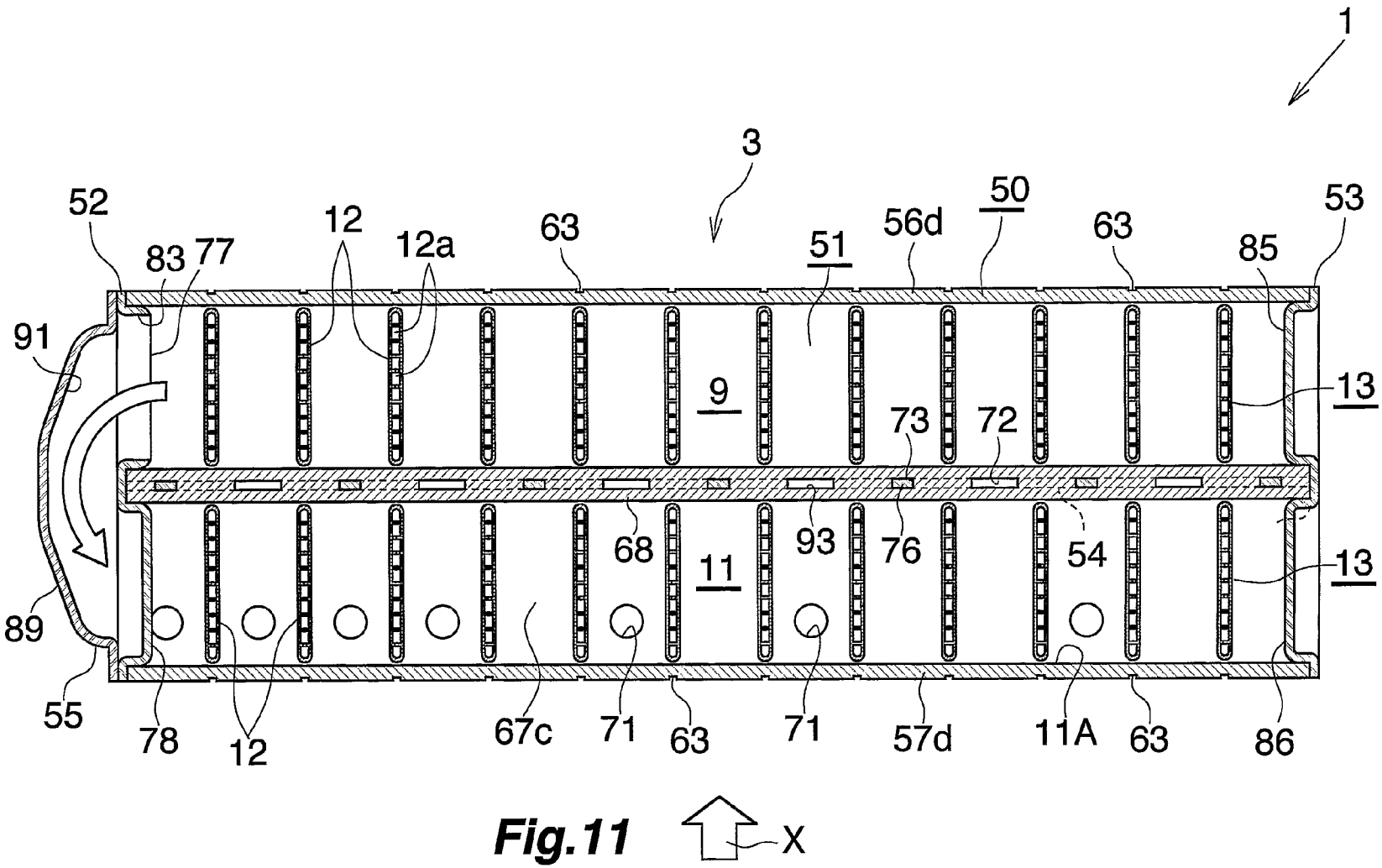
FIG. 11 is a sectional view taken along line F-F of FIG. 2.

FIGS. 1 to 3 show the overall configuration of an evaporator, and FIGS. 4 to 12 show the configuration of essential portions of the evaporator. FIG. 13 shows how a refrigerant flows in the evaporator.

In FIG. 1, the evaporator (1) includes a refrigerant inlet/outlet header tank (2) made of aluminum, a refrigerant turn header tank (3) made of aluminum, and a heat exchange core section (4) provided between the header tanks (2) and (3).

The refrigerant inlet/outlet header tank (2) includes a refrigerant inlet header section (5) located on a side toward the front (downstream side with respect to the air flow direction) and a refrigerant outlet header section (6) located on a side toward the rear (upstream side with respect to the air flow direction). A refrigerant inlet pipe (7) made of aluminum is connected to the refrigerant inlet header section (5) of the refrigerant inlet/outlet header tank (2). A refrigerant outlet pipe (8) made of aluminum is connected to the refrigerant outlet header section (6). The refrigerant turn header tank (3) includes a refrigerant inflow header section (9) (refrigerant-inflow-side intermediate header section) located on the side toward the front and a refrigerant outflow header section (11) (refrigerant-outflow-side intermediate header section) located on the side toward the rear.

The heat exchange core section (4) is configured such that heat exchange tube groups (13) are arranged in a plurality of; herein, two, rows in the front-rear direction, each heat exchange tube group (13) consisting of a plurality of heat exchange tubes (12) made of aluminum and arranged in parallel at predetermined intervals in the left-right direction. Corrugate fins (14) made of aluminum are disposed within air-passing clearances between the adjacent heat exchange tubes (12) of the heat exchange tube groups (13) and on the outer sides of the leftmost and rightmost heat exchange tubes (12) of the heat exchange tube groups (13), and are brazed to the corresponding heat exchange tubes (12). Side plates (15) made of aluminum are disposed on the outer sides of the leftmost and rightmost corrugate fins (14), and are brazed to the corresponding corrugate fins (14). The upper and lower ends of the heat exchange tubes (12) of the front heat exchange tube group (13) are connected to the refrigerant inlet header section (5) and the refrigerant inflow header section (9), respectively. The upper and lower ends of the heat exchange tubes (12) of the rear heat exchange tube group (13) are connected to the refrigerant outlet header section (6) and the refrigerant outflow header section (11), respectively.

As shown in FIGS. 2 to 6, the refrigerant inlet/outlet header tank (2) is formed from an aluminum brazing sheet having a brazing material layer on each of opposite sides thereof, and includes a first member (16) having a plate-like shape and to which the heat exchange tubes (12) are connected; a second member (17) formed from a bare aluminum extrudate and covering the upper side of the first member (16); and caps (18) and (19) (closing members) formed from aluminum and closing the left and right end openings. A joint plate (21) made of a bare aluminum material and elongated in the front-rear direction is brazed to the outer surface of the right-hand cap (19) while facing the respective ends of the refrigerant inlet header section (5) and the refrigerant outlet header section (6). The refrigerant inlet pipe (7) and the refrigerant outlet pipe (8) are joined to the joint plate (21).

The first member (16) has front and rear curved portions (22), whose central regions each have an arcuate cross section projecting downward and having a small curvature. A plurality of tube insertion holes (23), which are elongated in the front-rear direction, are formed in the curved portions (22) at predetermined intervals in the left-right direction. The tube insertion holes (23) of the front curved portion (22) and those of the rear curved portion (22) are identical in position in the left-right direction. A rising wall (22*a*) is formed integrally with each of the front edge of the front curved portion (22) and the rear edge of the rear curved portion (22), over the entire length of the front and rear edges. A plurality of through holes (25) are formed in a flat portion (24) located between the curved portions (22) of the first member (16), at predetermined intervals in the left-right direction.

The first member (16) is formed, by pressing, from an aluminum brazing sheet in such a manner as to form the curved portions (22), the rising walls (22*a*), the tube insertion holes (23), the flat portion (24), and the through holes (25).

The second member (17) has a cross section resembling the letter m, which opens downward, and includes front and rear walls (26) extending in the left-right direction; a partition wall (27) provided at a central region thereof between the front and rear walls (26), extending in the left-right direction, and serving as partition means for dividing the interior of the refrigerant inlet/outlet header tank (2) into a front space and a rear space; and two connection walls (28) each having a substantially arcuate cross section and projecting upward and integrally connecting the upper end of the partition wall (27) and the upper ends of the front and rear walls (26).

An intra-inlet-header-section flow-dividing control wall (10), which serves as flow-dividing control means, integrally connects a lower end portion of the front wall (26) of the second member (17) and a lower end portion of the partition wall (27) over the entire length thereof. At a level equal to that of the intra-inlet-header-section flow-dividing control wall (10), an intra-outlet-header-section flow-dividing control wall (29), which serves as flow-dividing control means, integrally connects a lower end portion of the rear wall (26) of the second member (17) and a lower end portion of the partition wall (27) over the entire length thereof. A cutout (10*a*) is formed in the intra-inlet-header-section flow-dividing control wall (10) in such a manner as to extend from the left end of the same. A plurality of elongated-circular refrigerant passage holes (31A) and (31B) in a through-hole form and elongated in the left-right direction are formed in a rear region, excluding left and right end portions thereof, of the intra-outlet-header-section flow-dividing control wall (29) at predetermined intervals in the left-right direction. The central elongated-circular refrigerant passage hole (31A) is Shorter than the other elongated-circular refrigerant passage hole (31B) and is located between the adjacent heat exchange tubes (12).

The lower end of the partition wall (27) projects downward beyond the lower ends of the front and rear walls (26). A plurality of projections (27*a*) are integrally formed on the lower end face of the partition wall (27) at predetermined intervals in the left-right direction in such a manner as to project downward, and are fitted into corresponding through holes (25) of the first member (16). The projections (27*a*) are formed by cutting off predetermined portions of the partition wall (27).

Herein, the intra-inlet-header-section flow-dividing control wall (10) is formed integrally with the front wall (26) and the partition wall (27), and the intra-outlet-header-section flow-dividing control wall (29) is formed integrally with the rear wall (26) and the partition wall (27). However, a separate member may be fixedly attached to the front wall (26) and to the partition wall (27) so as to form the intra-inlet-header-section flow-dividing control wall (10). Similarly, a separate member may be fixedly attached to the rear wall (26) and to the partition wall (27) so as to form the intra-outlet-header-section flow-dividing control wall (29).

The second member (17) is manufactured as follows. After the front and rear walls (26), the partition wall (27), the connection walls (28), and the two flow-dividing control walls (10) and (29) are integrally extrusion-molded. The resultant molded article undergoes pressing so as to form the cutout (10*a*) in the intra-inlet-header-section flow-dividing control wall (10) and to form the refrigerant passage holes (31A) and (31B) in the intra-outlet-header-section flow-dividing control wall (29). Further, predetermined portions of the partition wall (27) are cut off so as to form the projections (27*a*).

The caps (18) and (19) each assume a plate-like shape approximately corresponding to a cross-sectional shape of the outline of an assembly of the first and second members (16) and (17). The caps (18) and (19) are formed, by pressing, from an aluminum brazing sheet having a brazing material layer on each of opposite sides thereof. An upper, leftward projecting portion (30) and a lower, leftward projecting portion (32) are formed integrally with the right-hand cap (19) on the side toward the front, and are spaced apart from each other in the vertical direction. The upper, leftward projecting portion (30) is fitted into a space (5*a*) of the refrigerant inlet header section (5), the space (5*a*) being located above the flow-dividing control wall (10). The lower, leftward projecting portion (32) is fitted into a space (5*b*) of the refrigerant inlet header section (6), the space (5*b*) being located under the flow-dividing control wall (10). An upper, leftward projecting portion (33) and a lower, leftward projecting portion (34) are formed integrally with the right-hand cap (19) on the side toward the rear, and are spaced apart from each other in the vertical direction. The upper, leftward projecting portion (33) is fitted into a space (6*a*) of the refrigerant outlet header section (6), the space (6*a*) being located above the flow-dividing control wall (29). The lower, leftward projecting portion (34) is fitted into a space (6*b*) of the refrigerant outlet header section (6), the space (6*b*) being located under the flow-dividing control wall (29). An engagement finger (36) projecting leftward is formed integrally with the right-hand cap (19) at an arcuate portion extending between the front side edge and the top edge and an arcuate portion extending between the rear side edge and the top edge, as well as at a front portion and a rear portion of the bottom edge. A refrigerant inlet (37) is formed in the bottom wall of the front, upper, leftward projecting portion (30) of the right-hand cap (19). A flow-division-adjusting hole (20) (flow-division-adjusting refrigerant inflow port) is formed in the bottom wall of the front, lower, leftward-projecting portion (32). A refrigerant outlet (38) is formed in the bottom wall of the rear, upper, leftward projecting portion (33) of the right-hand cap (19).

A rightward projecting portion (39) is formed integrally with the left-hand cap (18) on the side toward the front. The rightward projecting portion (39) is fitted into the refrigerant inlet header section (5). An upper, rightward projecting portion (41) and a lower, rightward projecting portion (42) are formed integrally with the left-hand cap (18) on the side toward the rear, and are spaced apart from each other in the vertical direction. The upper, rightward projecting portion (41) is fitted into the space (6*a*) of the refrigerant outlet header section (6), the space (6*a*) being located above the flow-dividing control wall (29). The lower, rightward projecting portion (42) is fitted into the space (6*b*) of the refrigerant outlet header section (6), the space (6*b*) being located under the flow-dividing control wall (29). An engagement finger (43) projecting rightward is formed integrally with the left-hand cap (18) at an arcuate portion extending between the front side edge and the top edge and an arcuate portion extending between the rear side edge and the top edge, as well as at a front portion and a rear portion of the bottom edge. No opening is formed in the bottom walls of the rightward projecting portions (39), (41), and (42).

The joint plate (21) is formed from an aluminum bare material by pressing and includes a short, cylindrical refrigerant inflow port (45) communicating with the refrigerant inlet (37) and the flow-division-adjusting hole (20) of the right-hand cap (19), and a short, cylindrical refrigerant outflow port (46) communicating with the refrigerant outlet (38) of the right-hand cap (19). A bent portion (47) projecting leftward is formed at a portion of each of the upper and lower edge portions of the joint plate (21) located between the refrigerant inflow port (45) and the refrigerant outflow port (46). The upper and lower bent portions (47) are fitted into corresponding regions between the refrigerant inlet header section (5) and the refrigerant outlet header section (6). An engagement finger (48) projecting leftward is formed integrally with each of front and rear end portions of the lower edge of the joint plate (21). The engagement fingers (48) are fitted to the lower edge of the right-hand cap (19).

The first and second members (16) and (17) of the refrigerant inlet/outlet header tank (2), the caps (18) and (19), and the joint plate (21) are brazed together as follows. In assembly of the first and second members (16) and (17), the projections (27*a*) of the second member (17) are inserted into the corresponding through holes (25) of the first member (16), followed by crimping. As a result, upper end portions of the front and rear rising walls (22*a*) of the first member (16) are fitted to corresponding lower end portions of the front and rear walls (26) of the second member (17). In the thus-established condition, the first and second members (16) and (17) are brazed together by utilization of the brazing material layers of the first member (16). In attachment of the right-hand cap (19), the front, upper projecting portion (30) is fitted into the space defined by the first and second members (16) and (17) and located frontward of the partition wall (27) and above the intra-inlet-header-section flow-dividing control wall (10); the front, lower projecting portion (32) is fitted into the space defined by the first and second members (16) and (17) and located frontward of the partition wall (27) and under the intra-inlet-header-section flow-dividing control wall (10); the rear, upper projecting portion (33) is fitted into the space defined by the first and second members (16) and (17) and located rearward of the partition wall (27) and above the intra-outlet-header-section flow-dividing control wall (29); the rear, lower projecting portion (34) is fitted into the space defined by the first and second members (16) and (17) and located rearward of the partition wall (17) and under the intra-outlet-header-section flow-dividing control wall (29); the upper engagement fingers (36) are fitted to the connection walls (28) of the second member (17); and the lower engagement fingers (36) are fitted to the curved portions (22) of the first member (16). In the thus-established condition, the cap (19) is brazed to the first and second members (16) and (17) by utilization of the brazing material layers thereof. In attachment of the left-hand cap (18), the front projecting portion (39) is fitted into the space defined by the first and second members (16) and (17) and located frontward of the partition wall (27); the rear, upper projecting portion (41) is fitted into the space defined by the first and second members (16) and (17) and located rearward of the partition wall (27) and above the intra-outlet-header-section flow-dividing control wall (29); the rear, lower projecting portion (42) is fitted into the space defined by the first and second members (16) and (17) and located rearward of the partition wall (17) and under the intra-outlet-header-section flow-dividing control wall (29); the upper engagement fingers (43) are fitted to the connection walls (28) of the second member (17); and the lower engagement fingers (43) are fitted to the curved portions (22) of the first member (16). In the thus-established condition, the cap (18) is brazed to the first and second members (16) and (17) by utilization of the brazing material layers thereof. In attachment of the joint plate (21), the upper bent portion (47) is fitted to the right-hand cap (19) at a central portion with respect to the front-rear direction and to the second member (17) at a portion between the connection walls (28); the lower bent portion (47) is fitted to the right-hand cap (19) at a central portion with respect to the front-rear direction and to the flat portion (24) of the first member (16); and the engagement fingers (48) are fitted to the bottom edge portion of the right-hand cap (19). In the thus-established condition, the joint plate (21) is brazed to the right-hand cap (19) by utilization of the brazing material layers of the right-hand cap (19).

The refrigerant inlet/outlet header tank (2) is thus formed. A portion of the refrigerant inlet/outlet header tank (2) located frontward of the partition wall (27) of the second member (17) serves as the refrigerant inlet header section (5), and a portion of the refrigerant inlet/outlet header tank (2) located rearward of the partition wall (27) serves as the refrigerant outlet header section (6). The flow-dividing control wall (10) divides the interior of the refrigerant inlet header section (5) into the upper and lower spaces (5*a*) and (5*b*). The flow-dividing control wall (29) divides the interior of the refrigerant outlet header section (6) into the upper and lower spaces (6*a*) and (6*b*). The spaces (6*a*) and (6*b*) communicate with each other through the elongated-circular refrigerant passage holes (31A) and (31B). The refrigerant inlet (37) of the right-hand cap (19) communicates with the upper space (5*a*) of the refrigerant inlet header section (5); the flow-division-adjusting hole (20) communicates with the lower space (5*b*); and the refrigerant outlet (38) communicates with the upper space (6*a*) of the refrigerant outlet header section (6). The refrigerant inflow port (45) of the joint plate (21) communicates with the refrigerant inlet (37) and the flow-division-adjusting hole (20), and the refrigerant outflow port (46) communicates with the refrigerant outlet (38). The upper space (5*a*) of the refrigerant inlet header section (5) is a first space that communicates with the refrigerant inlet (37). The lower space (5*b*) is a second space that communicates with the heat exchange tubes (12) of the front heat exchange tube group (13). The left-hand cap (18) closes the left end opening of the cutout (10*a*) of the intra-inlet-header-section flow-dividing control wall (10), thereby forming a communication hole (40) that establishes communication between the spaces (5*a*) and (5*b*) at a left end portion thereof. The upper space (6*a*) of the refrigerant outlet header section (6) is a first space that communicates with the refrigerant outlet (38). The lower space (6*b*) is a second space that communicates with the heat exchange tubes (12) of the rear heat exchange tube group (13). Herein, the communication hole (40) is formed by means of closing the left end opening of the cutout (10*a*) with the cap (18). However, in place of such formation of the communication hole (40), a through hole may be formed at a left end portion of the intra-inlet-header-section flow-dividing control wall (10) so as to serve as a communication hole. In this case, an upper, rightward projecting portion to be fitted into the upper space (5*a*) of the refrigerant inlet header section (5), and a lower, rightward projecting portion to be fitted into the lower space (5*b*) are formed on the left-hand cap (18) on the side toward the front, in such a manner as to be spaced apart from each other in the vertical direction.

As shown in FIGS. 2, 3, and 7 to 11, the refrigerant inflow header section (9) and the refrigerant outflow header section (11) are connected to each other by a connection section (60). The header sections (9) and (11) and the connection section (60) define a drain gutter (70).

The refrigerant turn header tank (3) is formed from an aluminum brazing sheet having a brazing material layer on each of opposite sides thereof and includes a first member (50) having a plate-like shape and to which the heat exchange tubes (12) are connected; a second member (51) formed from a bare aluminum extrudate and covering the lower side of the first member (50); caps (52) and (53) formed from an aluminum brazing sheet having a brazing material layer on each of opposite sides thereof, and closing the left and right end openings of the first and second members (50) and (51); an auxiliary drain plate (54) formed from an aluminum bare material, elongated in the left-right direction, and joined to the connection section (60); and a communication member (55) formed from an aluminum bare material, elongated in the front-rear direction, and brazed to the outer surface of the left-hand cap (52) in such a manner as to face the ends of the refrigerant inflow header section (9) and the refrigerant outflow header section (11). The refrigerant inflow header section (9) and the refrigerant outflow header section (11) communicate with each other at their left end portions via the communication member (55).

Each of the refrigerant inflow header section (9) and the refrigerant outflow header section (11) has a top face, a front side face, a rear side face, and a bottom face. The top faces, excluding their inside and outside portions with respect to the front-rear direction, of the header sections (9) and (11) serve as horizontal flat faces (9*a*) and (11*a*), respectively. The inside portions with respect to the front-rear direction of the top faces of the header sections (9) and (11) serve as first low portions (9*b*) and (11*b*), respectively, which are of faces inclined linearly downward and toward the inside with respect to the front-rear direction. The first low portions (9*b*) and (11*b*) serve as front and rear side surfaces of the drain gutter (70). The front and rear side surfaces of the drain gutter (70) fan out upward and in the front-rear direction. Preferably, the first low portions (9*b*) and (11*b*) are inclined downward at an angle of 45 degrees or greater with respect to a horizontal plane. The front and rear side surfaces of the drain gutter (70); i.e., the first low portions (9*b*) and (11*b*) of the header sections (9) and (11), are not necessarily inclined linearly, but may be curved, so long as they fan out upward and in the front-rear direction. Outside portions with respect to the front-rear direction of the top faces of the header sections (9) and (11) serve as second low portions (9*c*) and (11*c*), respectively, which are of faces inclined linearly downward and toward the outside with respect to the front-rear direction. Preferably, the second low portions (9*c*) and (11*c*) are inclined downward at an angle of 45 degrees or greater with respect to a horizontal plane. The front and rear outside surfaces of the header sections (9) and (11) are connected to the corresponding second low portions (9*c*) and (11*c*) of the top faces.

The first member (50) includes a first header formation portion (56), which forms an upper portion of the refrigerant inflow header section (9); a second header formation portion (57), which forms an upper portion of the refrigerant outflow header section (11); and a connection wall (58), which connects the header formation portions (56) and (57) and forms the connection section (60). The first header formation portion (56) includes a horizontal flat top wall (56*a*); a first inclined wall (56*b*), which is formed integrally with the rear edge of the top wall (56*a*) over the entire length thereof and inclined rearward and downward; a second inclined wall (56*c*), which is formed integrally with the front edge of the top wall (56*a*) over the entire length thereof and inclined frontward and downward; and a vertical wall (56*d*), which is formed integrally with the front edge of the second inclined wall (56*c*) over the entire length thereof. The second header formation portion (57) includes a horizontal flat top wall (57*a*); a first inclined wall (57*b*), which is formed integrally with the front edge of the top wall (57*a*) over the entire length thereof and inclined frontward and downward; a second inclined wall (57*c*), which is formed integrally with the rear edge of the top wall (57*a*) over the entire length thereof and inclined rearward and downward; and a vertical wall (57*d*), which is formed integrally with the rear edge of the second inclined wall (57*c*) over the entire length thereof. The connection wall (58) integrally connects the lower edge of the first inclined wall (56*b*) of the first header formation portion (56) and the lower edge of the first inclined wall (57*b*) of the second header formation portion (57). The bottom end faces of the vertical walls (56*d*) and (57*d*) of the header formation portions (56) and (57), respectively, are inclined downward, and inward with respect to the front-rear direction. An outside portion of each of the bottom faces partially forms a stepped portion (69), which will be described later. The upper surface of the top wall (56*a*) of the first header formation portion (56) serves as the top face of the refrigerant inflow header section (9); i.e., as the horizontal flat face (9*a*); the upper surfaces of the inclined walls (56*b*) and (56*c*) serve as the low portions (9*b*) and (9*c*); and the outer surface of the vertical wall (56*c*) serves as an upper portion of the front surface of refrigerant inflow header section (9). The upper surface of the top wall (57*a*) of the second header formation portion (57) serves as the top face of the refrigerant outflow header section (11); i.e., as the horizontal flat face (11*a*); the upper surfaces of the inclined walls (57*b*) and (57*c*) serve as the low portions (11*b*) and (11*c*); and the outer surface of the vertical wall (57*d*) serves as an upper portion of the rear surface of the refrigerant outflow header section (11).

A plurality of tube insertion holes (59) elongated in the front-rear direction are formed in the header formation portions (56) and (57) of the first member (50) at predetermined intervals in the left-right direction. The tube insertion holes (59) of the header formation portion (56) and those of the header formation portion (57) are identical in position in the left-right direction. End portions, located on a side toward the connection section (60), of the tube insertion holes (59); i.e., rear end portions of the tube insertion holes (59) of the first header formation portion (56) and front end portions of the tube insertion holes (59) of the second header formation portion (57), are located in the first inclined walls (56*b*) and (57*b*), respectively. Thus, the end portions, located on the side toward the connection section (60), of the tube insertion holes (59) are located in the side surfaces of the drain gutter (70). Outer end portions, with respect to the front-rear direction, of the tube insertion holes (59); i.e., front end portions of the tube insertion holes (59) of the first header formation portion (56) and rear end portions of the tube insertion holes (59) of the second header formation portion (57), are located in the second inclined walls (56*c*) and (57*c*), respectively. Thus, the front and rear end portions of the tube insertion holes (59) are located in the second low portions (9*c*) and (11*c*) of the top faces of the header sections (9) and (11).

In the top walls (56*a*) and (57*a*) and the inclined walls (56*b*), (56*c*), (57*b*), and (57*c*) of the header formation portions (56) and (57) of the first member (50), their portions located on the left and right sides of each tube insertion hole (59) serve as inclined portions (61) that are inclined downward and toward the tube insertion hole (59). The inclined portions (61) located on the left and right sides of each tube insertion hole (59) define a recess (62). Drain grooves (63) for draining condensed water downward of the refrigerant turn header tank (3) are formed, in connection with the front and rear end portions of the corresponding tube insertion holes (59), on the upper surfaces of the second inclined walls (56*c*) and (57*c*) and the outer surfaces of the vertical walls (56*d*) and (57*d*) of the header formation portions (56) and (57) of the first member (50). The bottom of each drain groove (63) extends downward as the distance from the corresponding tube insertion hole (59) increases. The bottom of a portion of each drain groove (63) located on the second inclined wall (56*c*) or (57*c*); i.e., on the second low portion (9*c*) or (11*c*), is linearly inclined, with respect to a horizontal plane, downward and toward the front or the rear. Preferably, the bottom of the portion of each drain groove (63) located on the second low portion (9*c*) or (11*c*) is inclined at an angle of 45 degrees or greater with respect to the horizontal plane. The lower end of a portion of each drain groove (63) located on the vertical wall (56*d*) or (57*d*) opens at the bottom end face of the vertical wall (56*d*) or (57*d*) (see FIG. 8).

A plurality of drain through-holes (64) elongated in the left-right direction are formed in the connection wall (58) of the first member (50) at predetermined intervals in the left-right direction. Also, a plurality of fixation though-holes (65) are formed in the connection wall (58) of the first member (50) at predetermined intervals in the left-right direction while being shifted from the drain through-holes (64).

The first member (50) is formed, by pressing, from an aluminum brazing sheet in such a manner as to form the header formation portions (56) and (57); i.e., the top walls (56*a*) and (57*a*), the inclined walls (56*b*), (56*c*), (57*b*), and (57*c*), the vertical walls (56*d*) and (57*d*), the connection wall (58), the tube insertion holes (59), the inclined portions (61), and the drain grooves (63), and to form the drain through-holes (64) and the fixation through-holes (65) in the connection wall (58).

The second member (51) includes a first header formation portion (66), which forms a lower portion of the refrigerant inflow header section (9); a second header formation portion (67), which forms a lower portion of the refrigerant outflow header section (11); and a connection wall (68), which connects together the header formation portions (66) and (67) and is brazed to the connection wall (58) of the first member (50) to thereby form the connection section (60). The first header formation portion (66) includes front and rear walls (66*a*), and a bottom wall (66*b*) integrally connecting the bottom ends of the front and rear walls (66*a*), projecting downward, and having a substantially arcuate cross section. The second header formation portion (67) includes front and rear walls (67*a*); a bottom wall (67*b*) integrally connecting the bottom ends of the front and rear walls (67*a*), projecting downward, and having a substantially arcuate cross section; and a horizontal flow-dividing control wall (67*c*) integrally connecting upper end portions of the front and rear walls (67*a*). The connection wall (68) integrally connects an upper end portion of the rear wall (66*a*) of the first header formation portion (66) and an upper end portion of the front wall (67*a*) of the second header formation portion (67). The outer surface of the front wall (66*a*) of the first header formation portion (66) and the outer surface of the rear wall (67*a*) of the second header formation portion (67) are located inward, with respect to the front-rear direction, of the outer surface of the vertical wall (56*d*) of the first header formation portion (56) and the outer surface of the vertical wall (57*d*) of the second header formation portion (57), respectively, of the first member (50). Thus, the stepped portion (69) is provided at each of joint portions between the vertical walls (56*d*) and (57*d*) of the first member (50) and the front and rear walls (66*a*) and (67*a*) of the second member (51); the outer surfaces of the vertical walls (56*d*) and (57*d*) are located outward, with respect to the front-rear direction, of the outer surfaces of the front and rear walls (66*a*) and (67*a*), respectively, via the corresponding stepped portions (69); and the entire bottom end of each drain groove (63) opens at the corresponding stepped portion (69) (see FIGS. 8 and 9). The outer surface of an upper edge portion of the front wall (66*a*) of the first header formation portion (66) is flush with the bottom surface of a portion of the drain groove (63) located on the vertical wall (56*d*), and the outer surface of an upper edge portion of the rear wall (67*a*) of the second header formation portion (67) is flush with the bottom surface of a portion of the drain groove (63) located on the vertical wall (57*d*). The outer surface of the front wall (66*a*) of the first header formation portion (66) serves as a lower portion of the front surface of the refrigerant inflow header section (9). The outer surface of the rear wall (67*a*) of the second header formation portion (67) serves as a lower portion of the rear surface of the refrigerant outflow header section (11).

A plurality of circular refrigerant passage holes (71) in a through-hole form are formed in a rear region of the flow-dividing control wall (67*c*) of the second header formation portion (67) of the second member (51) at predetermined intervals in the left-right direction. The distance between the two adjacent circular refrigerant passage holes (71) increases gradually as the distance from the left end of the flow-dividing control wall (67*c*) increases. Notably, the distance between the two adjacent circular refrigerant passage holes (71) may be constant. A plurality of through holes (72) elongated in the left-right direction are formed in the connection wall (68) of the second member (51), in alignment with the corresponding drain through-holes (64) of the first member (50). Also, a plurality of fixation through-holes (73) are formed in the connection wall (68), in alignment with the corresponding fixation through-holes (65) of the first member (50).

The second member (51) is formed as follows. First, the front and rear walls (66*a*) and (67*a*) and the bottom walls (66*b*) and (67*b*) of the header formation portions (66) and (67), the flow-dividing control wall (67*c*) of the second header formation portion (67), and the connection wall (68) are integrally formed by extrusion. Subsequently, the resultant extrudate is subjected to press work so as to form the refrigerant passage holes (71) in the flow-dividing control wall (67*c*), and the drain through-holes (72) and the fixation through-holes (73) in the connection wall (68).

Cutouts (74) are formed in the auxiliary drain plate (54) in such a manner as to extend from its upper edge and to correspond to the drain through-holes (64) and (72) of the first and second members (50) and (51). The width of an open portion of the cutout (74) as measured in the left-right direction is equal to the length of the drain through-holes (64) and (72) as measured in the left-right direction. Auxiliary drain grooves (75) are formed on the front and rear surfaces of the auxiliary drain plate (54) as follows: the auxiliary drain grooves (75) extend vertically and are connected to the corresponding lower end portions of the cutouts (74); and their lower end portions are open at the bottom face of the auxiliary drain plate (54). Projections (76) are formed at the top edge of the auxiliary drain plate (54) in such a manner as to align with the corresponding fixation through-holes (65) and (73) of the first and second members (50) and (51) and to project upward so as to be inserted into the corresponding fixation through-holes (65) and (73). The auxiliary drain plate (54) is formed, by press work, from an aluminum bare material in such a manner as to form the cutouts (74), the auxiliary drain grooves (75), and the projections (76).

The caps (52) and (53) assume a plate-like form. They are formed, by pressing, from an aluminum brazing sheet having a brazing material layer on each of opposite sides thereof. A rightward projecting portion (77) to be fitted into the refrigerant inflow header section (9) is integrally formed on the left-hand cap (52) on the side toward the front. An upper, rightward projecting portion (78) and a lower, rightward projecting portion (79) are formed integrally with the left-hand cap (52) on the side toward the rear, and spaced apart from each other in the vertical direction. The upper, rightward projecting portion (78) is fitted into a space (11A) of the refrigerant outflow header section (11), the space (11A) being located above the flow-dividing control wall (67*c*). The lower, rightward projecting portion (79) is fitted into a space (11B) of the refrigerant outflow header section (11), the space (11B) being located under the flow-dividing control wall (67*c*). In the left-hand cap (52), an engagement finger (81) projecting rightward is formed integrally with each of an arcuate portion extending between the front side edge and the bottom edge and an arcuate portion extending between the rear side edge and the bottom edge, and is also formed integrally with the top edge at front and rear positions; and further, an engagement finger (82) projecting leftward is formed on each of the upper and lower edges at a central position with respect to the front-rear direction. Through holes (83) and (84) are formed in the bottom wall of the front, rightward projecting portion (77) and the bottom wall of the rear, lower, rightward projecting portion (79), respectively, of the left-hand cap (52). The front through hole (83) establishes communication between the interior and the exterior of the refrigerant inflow header section (9). The rear through hole (84) establishes communication between the interior and the exterior of the space (11B), located under the flow-dividing control wall (67*c*), of the refrigerant outflow header section (11).

A leftward projecting portion (85) to be fitted into the refrigerant inflow header section (9) is integrally formed on the right-hand cap (53) on the side toward the front. An upper, leftward projecting portion (86) and a lower, leftward projecting portion (87) are formed integrally with the right-hand cap (53) on the side toward the rear, and spaced apart from each other in the vertical direction. The upper, leftward projecting portion (86) is fitted into the space (11A) of the refrigerant outflow header section (11), the space (11A) being located above the flow-dividing control wall (67*c*). The lower, leftward projecting portion (87) is fitted into the space (11B) of the refrigerant outflow header section (11), the space (11B) being located under the flow-dividing control wall (67*c*). In the right-hand cap (53), an engagement finger (88) projecting leftward is formed integrally with each of an arcuate portion extending between the front side edge and the bottom edge, and an arcuate portion extending between the rear side edge and the bottom edge, and is also formed integrally with the top edge at front and rear positions. No through hole is formed in the bottom walls of the leftward projecting portions (85), (86), and (87).

The communication member (55) is formed, by press work, from an aluminum bear material and assumes, as viewed from the left, a plate-like form identical with that of the left-hand cap (52). A peripheral edge portion of the communication member (55) is brazed to the outer surface of the left-hand cap (52). An outward bulging portion (89) is formed on the communication member (55) so as to establish communication between the two through holes (83) and (84) of the left-hand cap (52). The interior of the outward bulging portion (89) serves as a communication channel (91) for establishing communication between the through holes (83) and (84) of the left-hand cap (52). A cutout (92) is formed on each of the upper and lower edges of the communication member (55) at a central position with respect to the front-rear direction. The engagement fingers (82) of the left-hand cap (52) are fitted into the corresponding cutouts (92).

In assembly of the refrigerant turn header tank (3), the first and second members (50) and (51), the caps (52) and (53), the auxiliary drain plate (54), and the communication member (55) are brazed together as follows. In assembly of the first member (50) and the second member (51), the connection walls (58) and (68) are brought in contact with each other such that the drain through-holes (64) and (72) are aligned with each other and such that the fixation through-holes (65) and (73) are aligned with each other; the bottom ends of the vertical walls (56*d*) and (57*d*) of the header formation portions (56) and (57) are engaged with the corresponding top ends of the front wall (66*a*) of the first header formation portion (66) and the rear wall (67*a*) of the second header formation portion (67); and the projections (76) of the auxiliary drain plate (54) are inserted, from below, into the fixation through-holes (73) and (65) of the members (50) and (51) and then crimped, thereby tacking the members (50) and (51) together. In the thus-established condition, these members are brazed together by utilization of the brazing material layers of the first member (50). The auxiliary drain plate (54) is brazed to the connection walls (58) and (68) of the members (50) and (51) by utilization of the brazing material layers of the first member (50). In attachment of the caps (52) and (53), the front projecting portions (77) and (85) are fitted into the space defined by the first header formation portions (56) and (66) of the members (50) and (51); the rear, upper projecting portions (78) and (86) are fitted into the upper space defined by the second header formation portions (57) and (67) of the members (50) and (51) and located above the flow-dividing control wall (67*c*); the rear, lower projecting portions (79) and (87) are fitted into the lower space defined by the second header formation portions (57) and (67) of the members (50) and (51) and located under the flow-dividing control wall (67*c*); the upper engagement fingers (81) and (88) are fitted to the first member (50); and the lower engagement fingers (81) and (88) are fitted to the second member (51). In the thus-established condition, the caps (52) and (53) are brazed to the first and second members (50) and (51) by utilization of the brazing material layers thereof. In attachment of the communication member (55), the communication member (55) is engaged with the left-hand cap (52) such that the engagement fingers (82) are fitted into the corresponding cutouts (92). In the thus-established condition, the communication member (55) is brazed to the left-hand cap (52) by utilization of the brazing material layers of the left-hand cap (52).

The refrigerant turn header tank (3) is thus formed. The first header formation portions (56) and (66) of the members (50) and (51) define the refrigerant inflow header section (9). The second header formation portions (57) and (67) define the refrigerant outflow header section (11). The flow-dividing control wall (67*c*) divides the interior of the refrigerant outflow header section (11) into the upper and lower spaces (11A) and (11B). The spaces (11A) and (11B) communicate with each other through the circular refrigerant passage holes (71). The front through hole (83) of the left-hand cap (52) communicates with the refrigerant inflow header section (9), and the rear through hole (84) of the left-hand cap (52) communicates with the lower space (11B) of the refrigerant outflow header section (11). The interior of the refrigerant inflow header section (9) and the lower space (11B) of the refrigerant outflow header section (11) communicate with each other via the through holes (83) and (84) of the left-hand cap (52) and the communication channel (91) in the outward bulging portion (89) of the communication member (55). The connection walls (58) and (68) of the members (50) and (51) define the connection section (60). The first low portion (9*b*) of the refrigerant inflow header section (9), the first low portion (11*b*) of the refrigerant outflow header section (11), and the connection section (60) define the drain gutter (70). The drain through-holes (64) and (72) of the connection walls (58) and (68) of the members (50) and (51) define the drain holes (93) of the connection section (60).

Each of the heat exchange tubes (12) constituting the front and rear heat exchange tube groups (13) is formed from a bare aluminum extrudate and assumes a flat form having a wide width in the front-rear direction. In the heat exchange tube (12), a plurality of refrigerant channels (12*a*) extending in the longitudinal direction thereof are formed in parallel therein. The front and rear end walls of the heat exchange tube (12) assume an outward projecting arcuate shape. The heat exchange tubes (12) of the front heat exchange tube group (13) and the heat exchange tubes (12) of the rear heat exchange tube group (13) are arranged in such a manner as to be identical in position in the left-right direction. Upper end portions of the heat exchange tubes (12) are inserted into the corresponding tube insertion holes (23) of the first member (16) of the refrigerant input/output header tank (2) and brazed to the first member (16) by utilization of the brazing material layers of the first member (16). Lower end portions of the heat exchange tubes (12) are inserted into the corresponding tube insertion holes (59) of the first member (50) of the refrigerant turn header tank (3) and brazed to the first member (50) by utilization of the brazing material layers of the first member (50). The heat exchange tubes (12) of the front heat exchange tube group (13) communicate with the refrigerant inlet header section (5) and the refrigerant inflow header section (9). The heat exchange tubes (12) of the rear heat exchange tube group (13) communicate with the refrigerant outlet header section (6) and the refrigerant outflow header section (11).

Preferably, the thickness of the heat exchange tube (12) as measured in the left-right direction; i.e., a tube height (h), is 0.75 mm to 1.5 mm (see FIG. 12); the width of the heat exchange tube (12) as measured in the front-rear direction is 12 mm to 18 mm; the wall thickness of the heat exchange tube (12) is 0.175 mm to 0.275 mm; the thickness of a partition wall separating the refrigerant channels (12*a*) from each other is 0.175 mm to 0.275 mm; the pitch of the partition walls is 0.5 mm to 3.0 mm; and the front and rear end walls each have a radius of curvature of 0.35 mm to 0.75 mm as measured on the outer surface thereof.

In place of use of the heat exchange tube (12) formed from an aluminum extrudate, a heat exchange tube to be used may be formed such that an inner fin is inserted into a seam welded pipe of aluminum so as to form a plurality of refrigerant channels therein. Alternatively, a heat exchange tube to be used may be formed as follows. An aluminum brazing sheet having a brazing material layer on each of opposite sides thereof is subjected to a rolling process so as to form a plate that includes two flat-wall-forming portions connected together via a connection portion; side-wall-forming portions, which are formed, in a bulging condition, integrally with the corresponding flat-wall-forming portions at their side edges located in opposition to the connection portion; and a plurality of partition-wall-forming portions, which are formed integrally with the flat-wall-forming portions in such a manner as to project from the flat-wall-forming portions, and to be arranged at predetermined intervals in the width direction of the flat-wall-forming portions. The thus-prepared plate is bent at the connection portion into a hairpin form such that the side-wall-forming portions abut each other, followed by brazing. The partition-wall-forming portions become partition walls. In this case, corrugate fins formed from a bare material are used.

Figure 12:
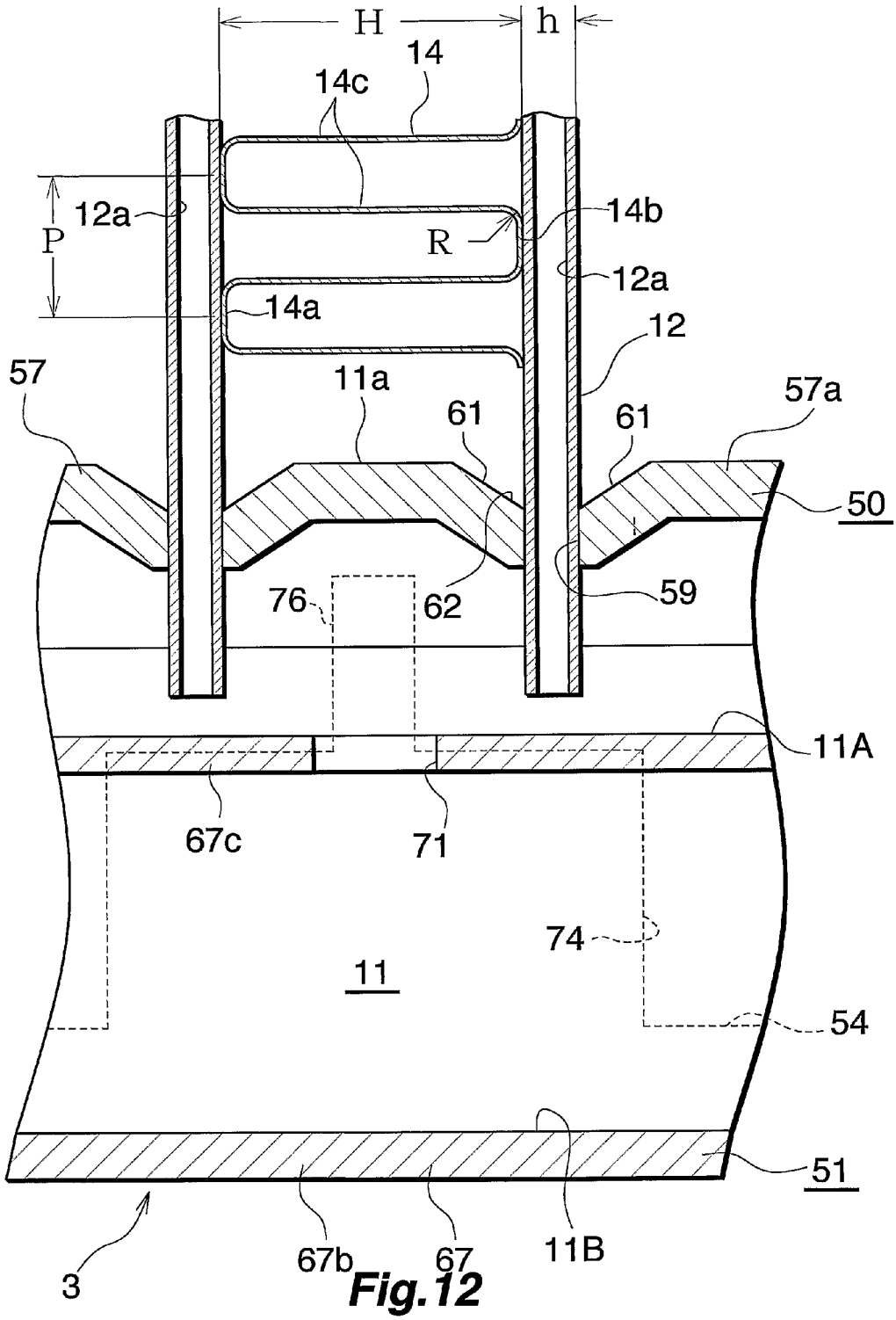
FIG. 12 is an enlarged sectional view taken along line G-G of FIG. 10.
Figure 13:
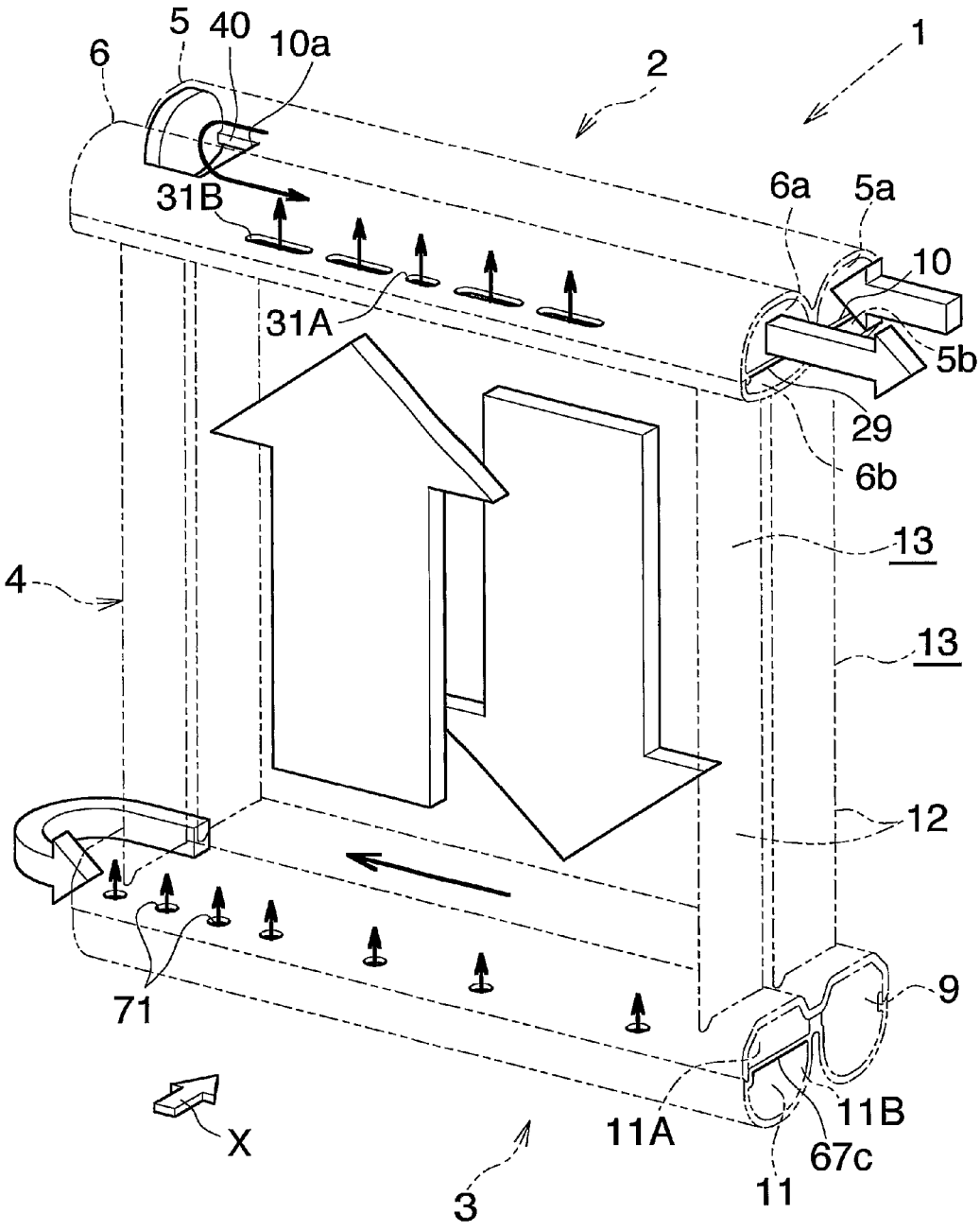
FIG. 13 is a diagram showing the flow of a refrigerant in the evaporator shown in FIG. 1.

As shown in FIG. 12, each of the corrugated fins (14) is made in a wavy form from an aluminum brazing sheet having a brazing material layer over opposite surfaces thereof. The corrugate fin (14) includes wave crest portions (14*a*), wave trough portions (14*b*), and horizontal flat connection portions each connecting together the wave crest portion (14*a*) and the wave trough portion (14*b*). A plurality of louvers are formed at the connection portions (14*c*) in such a manner as to be juxtaposed in the front-rear direction. The front and rear flat tubes (12) that constitute the refrigerant flow member (13) share the corrugate fin (14). The width of the corrugate fin (14) as measured in the front-rear direction is generally equal to the distance between the front edge of the front flat tube (12) and the rear edge of the rear flat tube (12). The wave crest portions (14*a*) and the wave trough portions (14*b*) of the corrugate fin (14) are brazed to the heat exchange tubes (12). Instead of a single corrugate fin being shared between the front and rear heat exchange tube groups (13), a corrugate fin may be disposed between the adjacent heat exchange tubes (12) of each of the front and rear heat exchange tube groups (13).

The fin height (H) of the corrugate fin (14) is the direct distance between the wave crest portion (14*a*) and the wave trough portion (14*b*), and is preferably 7.0 mm to 10.0 mm. The fin pitch (Pf) of the corrugate fin (14) is half the vertical interval (P) between the central portions of the adjacent wave crest portion (14*a*) (i.e., Pf=P/2), and the fin pitch (Pf) is preferably 1.3 mm to 1.7 mm. Each of the wave crest portion (14*a*) and the wave trough portion (14*b*) of the corrugate fin (14) includes a flat portion, which is brazed in a close contact condition to the heat exchange tubes (12), and round portions, which are located at corresponding opposite ends of the flat portion and connected to the corresponding connection portions (14*c*). Preferably, the round portions have a radius (R) of curvature of 0.7 mm or less.

In manufacture of the evaporator (1), component members thereof are assembled and tacked together, and the resultant assembly is subjected to batch brazing.

The evaporator (1), together with a compressor, a condenser, and an expansion valve, constitutes a refrigeration cycle, which uses a chlorofluorocarbon-based refrigerant and is installed in a vehicle, for example, an automobile, as a car air conditioner.

In the evaporator (1) described above, as shown in FIG. 13, two-phase refrigerant of vapor-liquid phase having passed through a compressor, a condenser, and an expansion valve enters the upper space (5*a*) of the refrigerant inlet header section (5) of the refrigerant inlet/outlet header tank (2) from the refrigerant inlet pipe (7) through the refrigerant inflow port (45) of the joint plate (21) and the refrigerant inlet (37) of the right-hand cap (19). Then, the refrigerant having entered the upper space (5*a*) flows leftward in the upper space (5*a*) and subsequently flows into the lower space (5*b*) while changing its course in a U-turn manner during passage through the communication hole (40) of the intra-inlet-header-section flow-dividing control wall (10). The refrigerant flows through the lower space (5*b*) rightward; i.e., in a direction counter to the flow direction within the upper space (5*a*). At the same time, the two-phase refrigerant directly enters the lower space (5*b*) from the refrigerant inlet pipe (7) through the refrigerant inflow port (45) of the joint plate (21) and the flow-division-adjusting hole (20) of the right-hand cap (19), without passing through the upper space (5*a*) of the refrigerant inlet header section (5), and flows leftward in the lower space (5*b*). The refrigerant having entered the lower space (5*b*) dividedly flows into the refrigerant channels (12*a*) of all of the heat exchange tubes (12) of the front heat exchange tube group (13).

The refrigerant having entered the refrigerant channels (12*a*) of the heat exchange tubes (12) flows downward through the refrigerant channels (12*a*) and enters the refrigerant inflow header section (9) of the refrigerant turn header tank (3). The refrigerant having entered the refrigerant inflow header section (9) flows leftward and then flows through the front through hole (83) of the left-hand cap (52), the communication channel (91) in the outward bulging portion (89) of the communication member (55), and the rear through hole (84) of the left-hand cap (52), thereby turning its flow direction and entering the lower space (11B) of the refrigerant outflow header (11).

Even when the distribution of temperature (dryness of refrigerant) of the refrigerant flowing through all of the heat exchange tubes (12) of the front heat exchange tube group (13) becomes nonuniform due to a failure in the refrigerant flowing from the refrigerant inlet header section (5) to all of the heat exchange tubes (12) of the front heat exchange tube group (13) in a uniformly divided condition, the refrigerant is mixed up when the refrigerant outflowing from the refrigerant inflow header section (9) turns its flow direction and flows into the lower space (11B) of the refrigerant outflow header section (11), so that its temperature becomes uniform.

The refrigerant having entered the lower space (11B) of the refrigerant outflow header section (11) flows rightward; enters the upper space (11A) through the circular refrigerant passage holes (71) of the flow-dividing control wall (67*c*); and dividedly flows into the refrigerant channels (12*a*) of all of the heat exchange tubes (12) of the rear heat exchange tube group (13).

The refrigerant having flown into the refrigerant channels (12*a*) of the heat exchange tubes (12) flows upward within the refrigerant channels (12*a*), in opposition to the previous flow direction; enters the lower space (6*b*) of the refrigerant outlet header section (6); and enters the upper space (6*a*) through the elongated refrigerant passage holes (31A) and (31B) of the intra-outlet-header-section flow-dividing control wall (29). Since the flow-dividing control wall (29) imparts resistance to the flow of the refrigerant, the divided flow from the upper space (11A) of the refrigerant outflow header section (11) to the heat exchange tubes (12) of the rear heat exchange tube group (13) becomes uniform, and the divided flow from the lower space (5*b*) of the refrigerant inlet header section (5) to the heat exchange tubes (12) of the front heat exchange group (13) becomes uniform to a greater extent. As a result, the refrigerant flow rate becomes uniform among all the heat exchange tubes (12) of the two heat exchange tube groups (13), so that the temperature distribution throughout the heat exchange core section (4) becomes uniform.

Next, the refrigerant having entered the upper space (6*a*) of the refrigerant outlet header section (6) flows out to the refrigerant outlet pipe (8) through the refrigerant outlet (38) of the right-hand cap (19) and the refrigerant outflow port (46) of the joint plate (21). While flowing through the refrigerant channels (12*a*) of the heat exchange tubes (12) of the front heat exchange tube group (13) and through the refrigerant channels (12*a*) of the heat exchange tubes (12) of the rear heat exchange tube group (13), the refrigerant is subjected to heat exchange with the air flowing through the air-passing clearances in the direction of arrow X shown in FIGS. 1 and 13 and flows out from the evaporator (1) in a vapor phase.

During the heat exchange, condensed water is generated on the surface of the corrugate fins (14). The condensed water flows down onto the refrigerant inflow header section (9) and the refrigerant outflow header section (11) of the refrigerant turn header tank (3). Condensed water that flows down along the rear end surfaces of the heat exchange tubes (12) of the front heat exchange tube group (13) and along the front end surfaces of the heat exchange tubes (12) of the rear heat exchange tube group (13) directly enters the drain gutter (70); flows down along the front and rear side surfaces of the drain gutter (70); and reaches the connection section (60), which is the bottom surface of the drain gutter (70). When the condensed water collected in the drain gutter (70) reaches a certain amount, the condensed water flows down the connection section (60) through the drain holes (93); flows along side edge portions of the cutouts (74) of the auxiliary drain plate (54); enters the auxiliary drain grooves (75); flows down in the auxiliary drain grooves (75); and drops downward below the refrigerant turn header tank (3) from the bottom end openings of the auxiliary drain grooves (75).

Condensed water that flows down along the front end surfaces of the heat exchange tubes (12) of the front heat exchange tube group (13) and along the rear end surfaces of the heat exchange tubes (12) of the rear heat exchange tube group (13) enters the drain grooves (63); flows in the drain grooves (63); and drops downward below the refrigerant turn header tank (3) from the bottom end openings of the drain grooves (63); i.e., from the openings of the stepped portions (69).

Condensed water that has flowed down onto the horizontal flat faces (9*a*) and (11*a*) of the refrigerant inflow header section (9) and the refrigerant outflow header section (11), respectively, of the refrigerant turn header tank (3) enters, by the capillary effect, the recesses (62) defined by the inclined portions (61) located on the left and right sides of the individual tube insertion holes (59); directly enters the drain gutter (70) from the inner end portions, with respect to the front-rear direction, of the recesses (62); flows down along the front and rear side surfaces of the drain gutter (70); and reaches the connection section (60), which is the bottom surface of the drain gutter (70). Subsequently, the condensed water drops downward below the refrigerant turn header tank (3) in the above-described manner. Also, the condensed water that has entered the recesses (62) flows into the drain grooves (63) from the outer end portions, with respect to the front-rear direction, of the recesses (62); flows in the drain grooves (63); and drops downward below the refrigerant turn header tank (3) from the bottom end openings of the drain grooves (63). Further, condensed water that has not entered the recesses (62) flows toward the downstream side with respect to the air flow direction; i.e., frontward, while overcoming, by the effect of wind flowing through the air-passing clearances between the adjacent heat exchange tubes (12), surface tension which could otherwise causes the condensed water to stagnate on the horizontal flat faces (9*a*) and (11*a*). The condensed water on the horizontal flat face (9*a*) of the refrigerant inflow header section (9) flows along the second low portions (9*c*) and drops downward below the refrigerant turn header tank (3). At this time, since the outer surface of the vertical wall (56*c*) of the first member (50) is located outward, with respect to the front-rear direction, of the outer surface of the front wall (66*a*) of the second member (51), the stepped portion (69) formed therebetween yields a draining effect, so that the condensed water effectively drops downward below the refrigerant turn header tank (3). Meanwhile, the condensed water on the horizontal flat face (11*a*) of the refrigerant outflow header section (11) flows along the first low portions (11*b*); enters the drain gutter (70); and drops downward below the refrigerant turn header tank (3). This mechanism prevents freezing of condensed water which could otherwise result from stagnation of condensed water in a large amount in the regions between the bottom ends of the corrugate fins (14) and the horizontal flat faces (9*a*) and (11*a*) of the header sections (9) and (11) of the refrigerant turn header tank (3). As a result, a drop in performance of the evaporator (1) is prevented.

Since the intra-inlet-header-section flow-dividing control wall (10) divides the refrigerant inlet header section (5) into the upper and lower spaces (5*a*) and (5*b*), the internal volume of each of the spaces (5*a*) and (5*b*) becomes relatively small. Thus, the flow velocity of the refrigerant within the spaces (5*a*) and (5*b*) becomes high, and the internal volume of the lower space (5*b*) with which the heat exchange tubes (12) communicate becomes small. By virtue of these features combined with the structural feature that the refrigerant flows into the lower space (5*b*) through the flow-division-adjusting hole (20) without passing through the upper space (5*a*), when a compressor is turned on, the quantity of refrigerant flowing into the lower space (5*b*) promptly builds up to a predetermined level, and the refrigerant flows into the heat exchange tubes (12). Thus, time that elapses before the evaporator (1) begins to be cooled is shortened. On the contrary, when the compressor is turned off, the variation in the left-right direction of the quantity of the refrigerant remaining in the lower space (5*b*) is suppressed, so that distribution of temperature rises in the evaporator (1) becomes uniform with a resultant uniform distribution of discharged air temperature, which is the temperature of wind passing through the heat exchange core section (4). Accordingly, at the time of on-off control of the compressor, the evaporator (1) exhibits quick response. Further, since the flow velocity of the refrigerant within the spaces (5*a*) and (5*b*) becomes high, combined with the structural feature that the refrigerant flows into the lower space (5*b*) through the flow-division-adjusting hole (20) without passing through the upper space (5*a*), even at low refrigerant flow rate, the refrigerant that has flowed into the refrigerant inlet header section (5) readily flows throughout the lower space (5*b*), so that the refrigerant flow rate becomes uniform among all of the heat exchange tubes (12) of the front heat exchange tube group (13). As a result, distribution of the quantity of refrigerant contributing to heat exchange becomes uniform in the heat exchange core section (4) with respect to the left-right direction, and the temperature distribution of air that has passed through the heat exchange core section (4) becomes uniform throughout. Therefore, the heat exchange performance of the evaporator (1) is greatly enhanced.

Passing through the flow-division-adjusting hole (20) of the right-hand cap (19), the refrigerant directly flows into a right end portion of the lower space (5*b*); i.e., a most distant portion of the lower space (5*b*) from the refrigerant inlet (37). Thus, a large quantity of refrigerant can flow to the right end portion of the lower space (5*b*) where, at low refrigerant flow rate, the refrigerant would otherwise fail to sufficiently reach. Therefore, the refrigerant flow rate becomes uniform among the heat exchange tubes (12) of the front heat exchange tube group (13), so that heat exchange performance of the evaporator (1) is enhanced.

In the above-described embodiment, a single heat exchange tube group (13) is provided between the refrigerant inlet header section (5) and the refrigerant inflow header section (9) of the header tanks (2) and (3), respectively, and a single heat exchange tube group (13) is provided between the refrigerant outlet header section (6) and the refrigerant outflow header section (11) of the header tanks (2) and (3), respectively. However, the present invention is not limited thereto. For example, the following configuration may be employed: one or more heat exchange groups (13) are provided between the refrigerant inlet header section (5) and the refrigerant inflow header section (9) of the header tanks (2) and (3), respectively, and one or more heat exchange groups (13) are provided between the refrigerant outlet header section (6) and the refrigerant outflow header section (11). In the above-described embodiment, the refrigerant input/output header tank (2) is located above the refrigerant turn header tank (3). However, this may be reversed; i.e., the refrigerant turn header tank (3) may be located above the refrigerant input/output header tank (2).

In the above-described embodiment, the heat exchanger of the present invention is applied to an evaporator. However, the present invention is not limited thereto.

In the above-described embodiment, communication between the refrigerant inflow header section (9) of the refrigerant turn header tank (3) and the lower space (11B) of the refrigerant outflow header section (11) is established at the end portion opposite the refrigerant inlet (37) of the refrigerant inlet header section (5). However, alternatively, such communication may be established at the end portion where the refrigerant inlet (37) is provided.

The heat exchanger of the present invention may be used as an evaporator of a car air conditioner used in a vehicle, for example, an automobile, the car air conditioner including a compressor, a gas cooler, an intermediate heat exchanger, a pressure-reducing device, and an evaporator and using a supercritical refrigerant such as a $CO_2$ refrigerant.

INDUSTRIAL APPLICABILITY

The heat exchanger of the present invention is favorably used as an evaporator for use in a car air conditioner, which is a refrigeration cycle mounted on, for example, an automobile.

The invention claimed is:

1. A heat exchanger comprising a refrigerant inlet header section having a refrigerant inlet at a first end portion thereof and a plurality of heat exchange tubes disposed at predetermined intervals in the longitudinal direction of the refrigerant inlet header section and connected at respective first end portions thereof to the refrigerant inlet header section, wherein the interior of the refrigerant inlet header section is divided into a first space into which a refrigerant flows through the refrigerant inlet, and a second space which communicates with the heat exchange tubes; the first and second spaces communicate with each other via a communication portion so as to generate, in the second space, a flow of the refrigerant in a direction counter to a refrigerant flow direction in the first space; and a flow-division-adjusting refrigerant inflow port communicating with the second space is formed at the first end portion of the refrigerant inlet header section such that the refrigerant flows into the second space through the flow-division-adjusting refrigerant inflow port without passing through the first space.

2. A heat exchanger according to claim 1, wherein the refrigerant flows into the second space from the first space while changing its course in a U-turn manner during passage through the communication portion.

3. A heat exchanger according to claim 1, wherein the first and second spaces of the refrigerant inlet header section communicate with each other via the communication portion at an end portion opposite the first end portion of the refrigerant inlet header section.

4. A heat exchanger according to claim 1, wherein the interior of the refrigerant inlet header section is divided into the first space and the second space by flow-dividing control means, and the communication portion comprises a communication hole formed in the flow-dividing control means.

5. A heat exchanger according to claim 4, wherein one end of the refrigerant inlet header section is closed to form a closed portion, and the refrigerant inlet communicating with the first space, and the flow-division-adjusting refrigerant inflow port assuming the form of a hole and communicating with the second space are formed at the closed portion.

6. A heat exchanger according to claim 5, wherein the opening area of the communication hole is greater than the opening area of the flow-division-adjusting refrigerant inflow port.

7. A heat exchanger according to claim 6, wherein the relation $0.05 \leqq A2/A1 \leqq 0.48$ is satisfied, where A1 is the opening area in $mm^2$ of the communication hole, and A2 is the opening area in $mm^2$ of the flow-division-adjusting refrigerant inflow port.

8. A heat exchanger according to claim 1, comprising a refrigerant inlet header section having a refrigerant inlet, a refrigerant outlet header section located rearward of the refrigerant inlet header section and having a refrigerant outlet, and a refrigerant circulation path establishing communication between the refrigerant inlet header section and the refrigerant outlet header section, wherein the refrigerant circulation path comprises at least two intermediate header sections, and a plurality of heat exchange tubes establishing communication among the refrigerant inlet header section, the refrigerant outlet header section, and all the intermediate header sections.

9. A heat exchanger according to claim 1, comprising a heat exchange core section configured such that heat exchange tube groups are arranged in a plurality of rows in a front-rear direction, each heat exchange tube group consisting of a plurality of heat exchange tubes arranged at predetermined intervals and such that fins are respectively disposed between the adjacent heat exchange tubes; a refrigerant inlet header section which is disposed on a first-end side of the heat exchange tubes and to which the heat exchange tubes of at least a single heat exchange tube group are connected; a refrigerant outlet header section which is disposed on the first-end side of the heat exchange tubes and rearward of the refrigerant inlet header section and to which the heat exchange tubes of the remaining heat exchange tube group(s) are connected; a refrigerant-inflow-side intermediate header section which is disposed on a second-end side of the heat exchange tubes and to which the heat exchange tubes connected to the refrigerant inlet header section are connected; and a refrigerant-outflow-side intermediate header section which is disposed on the second-end side of the heat exchange tubes and rearward of the refrigerant-inflow-side intermediate header section and to which the heat exchange tubes of the heat exchange tube group connected to the refrigerant outlet header section are connected.

10. A heat exchanger according to claim 9, wherein the heat exchange tubes are each in a flat form and are arranged such that their widths extend in the front-rear direction, and the individual heat exchange tubes have a tube height of 0.75 mm to 1.5 mm.

11. A heat exchanger according to claim 9, wherein each of the fins is in a corrugate form and comprises wave crest portions, wave trough portions, and flat connection portions connecting together the wave crest portions and the wave trough portions; and each of the fins has a fin height of 7.0 mm to 10.0 mm and a fin pitch of 1.3 mm to 1.7 mm.

12. A heat exchanger according to claim 9, wherein each of the wave crest portions and the wave trough portions of the corrugate fin comprises a flat portion, and round portions located at corresponding opposite ends of the flat portion and connected to the corresponding connection portions; and the round portions have a radius of curvature of 0.7 mm or less.

13. A heat exchanger according to claim 9, wherein the refrigerant inlet header section and the refrigerant outlet header section are provided in a single header tank.

14. A heat exchanger according to claim 13, wherein the header tank comprises a first member to which the heat exchange tubes are connected, a second member which is brazed to the first member on a side opposite the heat exchange tubes, and two closing members brazed to corresponding opposite ends of the first and second members.

15. A heat exchanger according to claim 14, wherein the refrigerant inlet communicating with the first space of the refrigerant inlet header section, the flow-division-adjusting refrigerant inflow port communicating with the second space of the refrigerant inlet header section, and the refrigerant outlet communicating with the refrigerant outlet header section are formed in one of the two closing members.

16. A refrigeration cycle comprising a compressor, a condenser, and an evaporator, the evaporator being a heat exchanger according to claim 1.

17. A vehicle having installed therein a refrigeration cycle according to claim 16 as a car air conditioner.

* * * * *